US008857361B2

(12) United States Patent
Alden et al.

(10) Patent No.: US 8,857,361 B2
(45) Date of Patent: Oct. 14, 2014

(54) SYSTEM, METHOD, AND APPARATUS FOR STORING AND DEPLOYING AUXILIARY VESSELS

(75) Inventors: Robert E. Alden, Webster, NY (US); David J. O'Neill, Falls Church, VA (US)

(73) Assignee: Robert E. Alden, Webster, NY (US)

( * ) Notice: Subject to any disclaimer, the term of this patent is extended or adjusted under 35 U.S.C. 154(b) by 277 days.

(21) Appl. No.: 13/547,676

(22) Filed: Jul. 12, 2012

(65) Prior Publication Data

US 2013/0014686 A1 Jan. 17, 2013

Related U.S. Application Data

(60) Provisional application No. 61/507,147, filed on Jul. 13, 2011.

(51) Int. Cl.
*B63B 35/40* (2006.01)

(52) U.S. Cl.
USPC ..... 114/259

(58) Field of Classification Search
CPC ..... B63C 9/22; B63C 9/23; B63B 23/30
USPC ..... 114/259, 364, 365–380
See application file for complete search history.

(56) References Cited

U.S. PATENT DOCUMENTS 1,475,290 A * 11/1923 Ellison et al. ..... 114/365
2,761,571 A * 9/1956 Adams ..... 414/137.7
4,878,450 A * 11/1989 Schmidt, Jr. ..... 114/259
8,631,752 B2 * 1/2014 Hauersperger ..... 114/259

* cited by examiner

*Primary Examiner* — Daniel V Venne
(74) *Attorney, Agent, or Firm* — H.C. Park & Associates, PLC

(57) ABSTRACT

An approach is provided for storing secondary maritime vessels to primary maritime vessels. A first signal is caused, at least in part, to be received to actuate a drive mechanism configured to cause, at least in part, a secondary vessel to be moored in a first state to a primary vessel. The drive mechanism is caused, at least in part, to be actuated in a first direction based on the first signal, wherein causing, at least in part, the drive mechanism to be actuated in the first direction is configured to cause, at least in part, a drawing mechanism to draw the secondary vessel towards the primary vessel and configured to cause, at least in part, a lifting mechanism to raise the secondary vessel from a substantially horizontal plane to the first state.

20 Claims, 22 Drawing Sheets

SYSTEM, METHOD, AND APPARATUS FOR STORING AND DEPLOYING AUXILIARY VESSELS

CROSS-REFERENCE TO RELATED APPLICATION

This application claims the benefit of U.S. Provisional Application No. 61/507,147, filed Jul. 13, 2011, and entitled "System, Method, and Apparatus for Storing and Deploying Auxiliary Vessels," the entire contents of which are incorporated, herein, by reference.

BACKGROUND INFORMATION

Auxiliary vessels, such as dinghies, personal watercrafts, skiffs, tenders, and the like, are often utilized in association with primary vessels, e.g., cruise liners, sailboats, ships, tankers, yachts, etc., for various maritime applications. For instance, auxiliary vessels may be utilized to transport people and/or cargo from a moored primary vessel to a destination of is interest. Various combinations of weight, obstacles (riggings, railings, etc.), wave-induced motions, and physical capabilities, often makes storing and deploying auxiliary vessels problematic, if not dangerous for boaters. Conventionally, owners of primary vessels have resorted to complex crane or davit installed solutions that, while providing at least some powered or mechanized advantages, tend to occupy inordinate amounts of precious boating space (e.g., deck, railing, transom, etc.), not to mention impede the use of other surrounding spaces. Further, these crane and davit installed solutions often detract from the aesthetic appearance of the primary vessel. It is further noted that when auxiliary vessels include outboard propulsion devices, these solutions also generally require the outboard propulsion devices to be lifted off the auxiliary vessels and loaded onto the primary vessels before the auxiliary vessels can be stored or moored. Due to the weight of typical outboard propulsion devices, this is often a difficult, laborious, and dangerous task. Moreover, conventional crane and davit installed solutions are quite expensive.

Therefore, there is a need for an approach that provides safer, more cost effective auxiliary vessels, as well as safer, more cost effective mechanisms to store and deploy these auxiliary vessels.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION

A preferred system, method, apparatus, and software for storing and deploying auxiliary vessels are described. In the following description, for the purposes of explanation, numerous specific details are set forth in order to provide a thorough understanding of various preferred embodiments. It is apparent, however, that the preferred embodiments may be practiced without these specific details or with one or more equivalent arrangements. In other instances, well-known structures and devices are shown in block diagram form in order to avoid unnecessarily obscuring the preferred embodiments.

Although the various exemplary embodiments are described with respect to maritime environments, it is contemplated that various exemplary embodiments are also applicable to other environments conducive to storage, such as industrial, commercial, residential, and the like environments.

Figure 1:
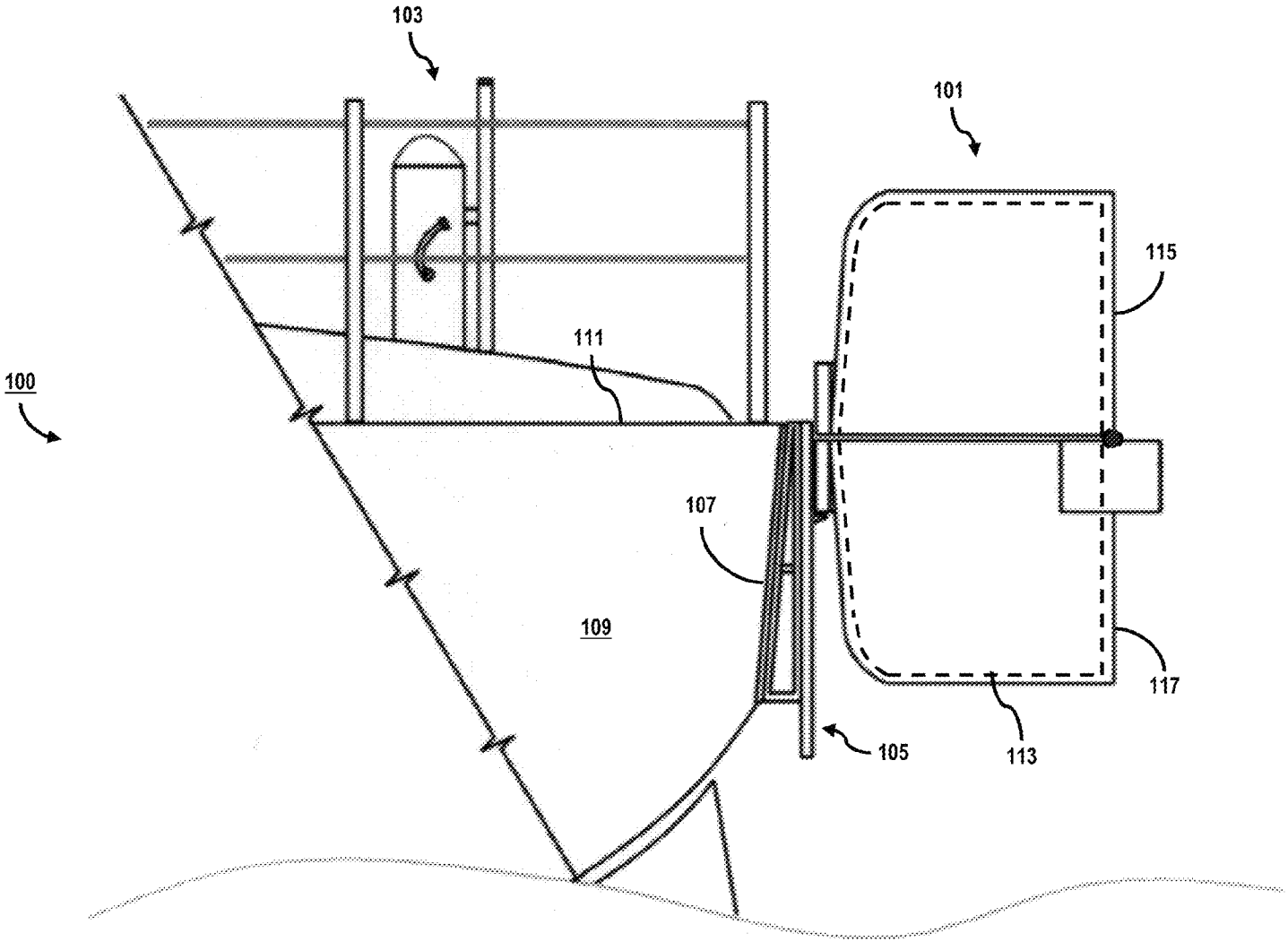
FIG. 1 is a side elevation view of a foldable auxiliary vessel stored to a primary vessel, according to an exemplary embodiment.

FIG. 1 is a side elevation view of a foldable auxiliary vessel stored to a primary vessel, according to an exemplary embodiment. For the purposes of illustration, system 100 for storing and deploying an auxiliary (or secondary) vessel 101, such as a dinghy, keelboat, skiff, tender, or other personal watercraft, to and from a primary vessel 103, e.g., a cruise liner, sailboat, ship, tanker, yacht, etc., is described with respect to storing and deploying mechanism (or mechanism) 105. As shown, mechanism 105 is mounted to transom 107 of primary vessel 103; however, it is contemplated, that mechanism 105 may be mounted to any other suitable portion of primary vessel 103, such as a bow portion (not shown), a port portion 109, a starboard portion (not shown), a deck portion 111, and/or the like. In this manner, while only one mechanism 105 is illustrated, it is envisioned that any number of suitable mechanisms 105 may be utilized to store and deploy any suitable number of auxiliary vessels 101 to primary vessel 103. It is also noted that auxiliary vessel 101 is shown as an unballasted, manually or otherwise powered maritime vessel capable of creating an enclosed interior cavity region (or environment) 113 when a first hull portion 115 is rotated (or otherwise folded) atop a second hull portion 117, as will become more apparent below. According to other embodiments, auxiliary vessel 101 may be ballasted and/or include one or more propulsion devices. Thus, while specific reference will be made to the various illustrated embodiments, it is contemplated that system 100 and its several features may embody many forms and include multiple and/or alternative components and configurations.

Figure 2:
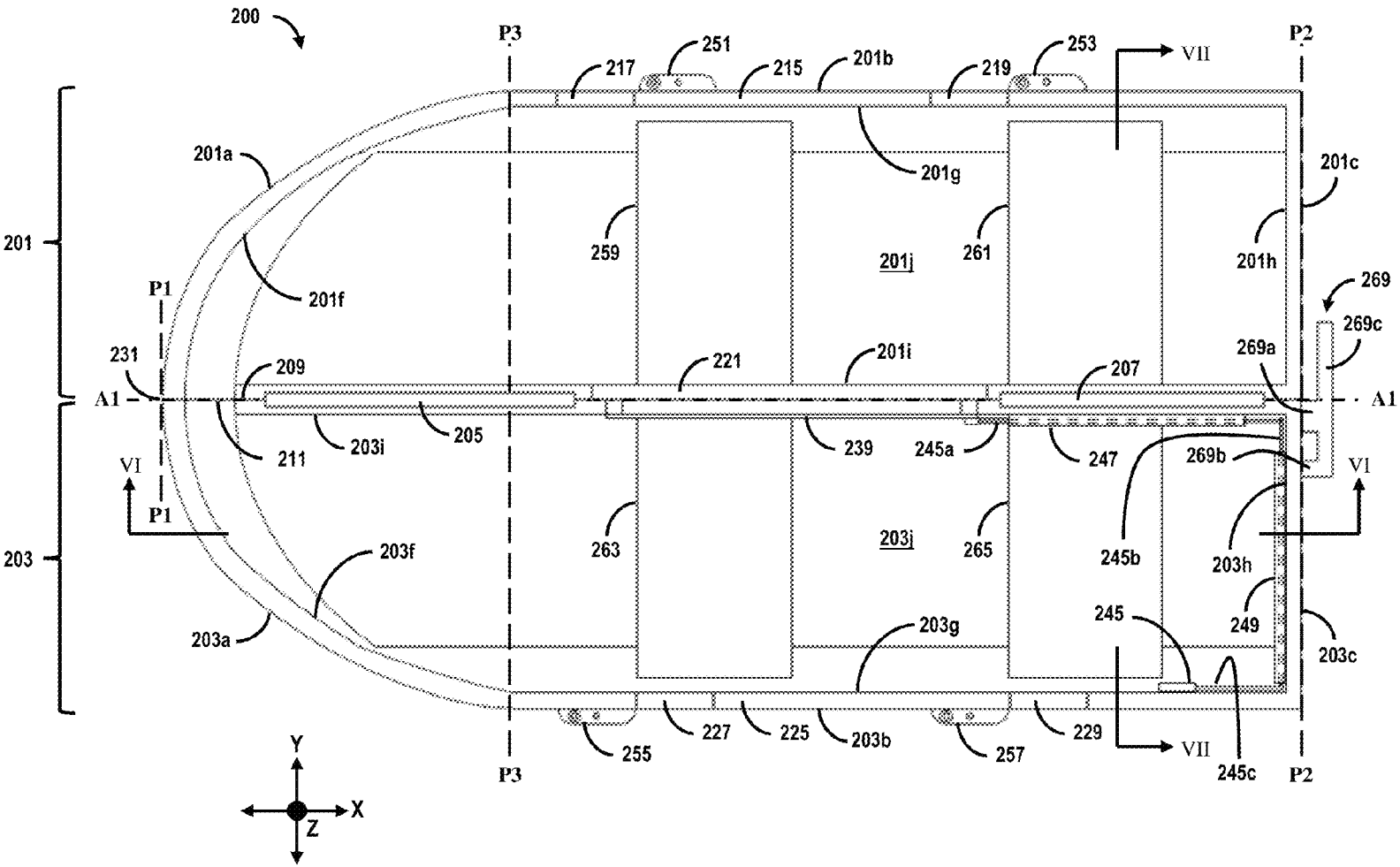
FIG. 2 is a plan view of a foldable auxiliary vessel, according to an exemplary embodiment.
Figure 4:
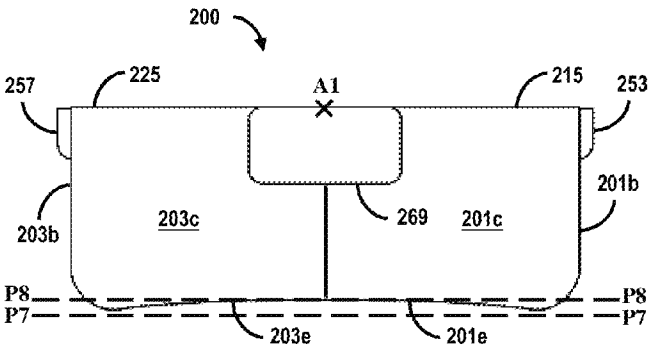
FIG. 4 is a rear elevation view of the foldable auxiliary vessel of FIG. 2, according to an exemplary embodiment.
Figure 3:
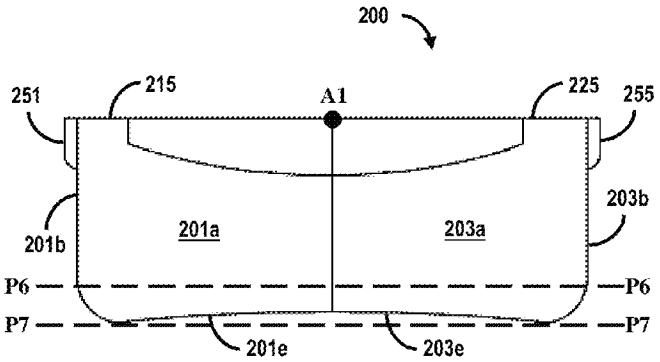
FIG. 3 is a front elevation view of the foldable auxiliary vessel of FIG. 2, according to an exemplary embodiment.
Figure 5:
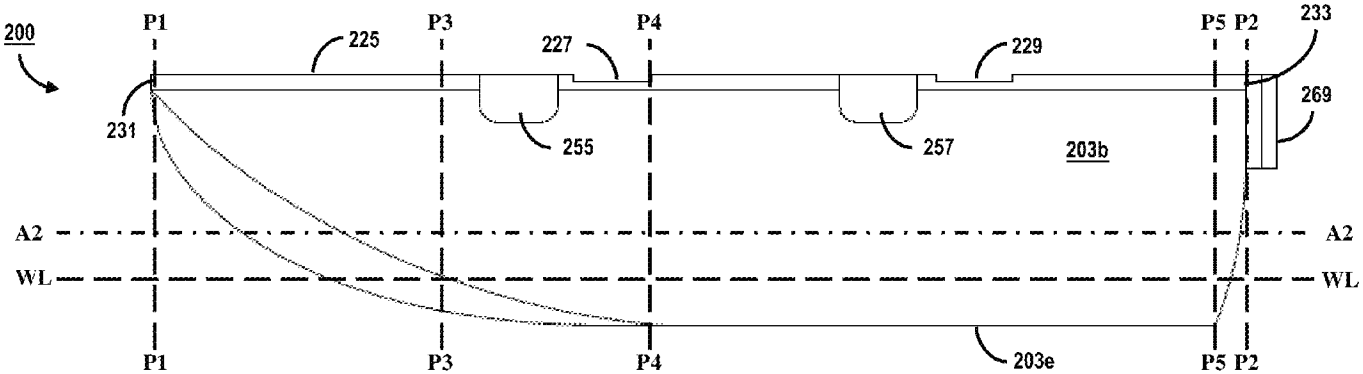
FIG. 5 is a side elevation view of the foldable auxiliary vessel of FIG. 2, according to an exemplary embodiment.
Figure 6:
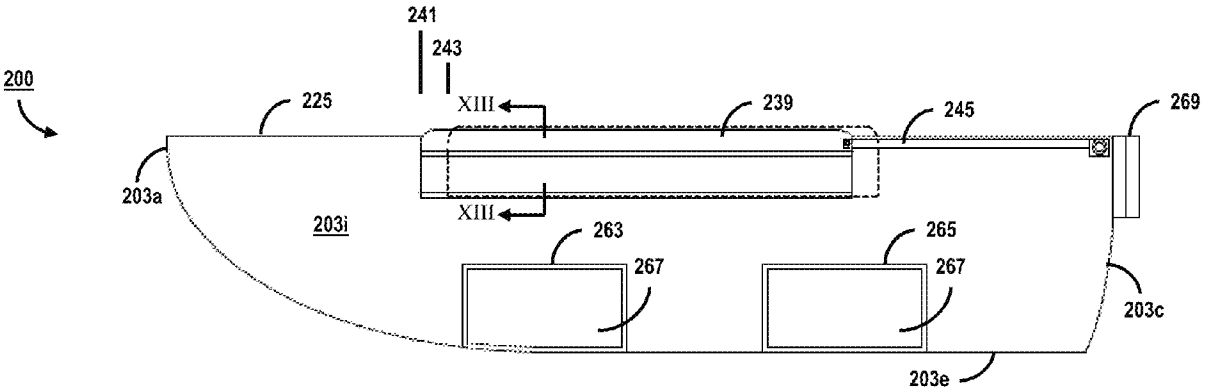
FIG. 6 is a sectional view of the foldable auxiliary vessel of FIG. 2 taken along sectional line VI-VI, according to an exemplary embodiment.
Figure 7:
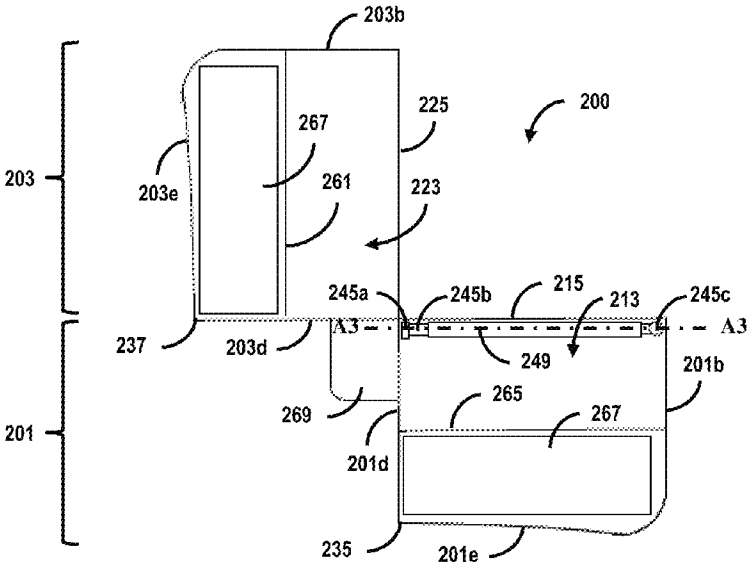
FIG. 7 is a sectional view of the foldable auxiliary vessel of FIG. 2 taken along sectional line VII-VII in a partially folded state, according to an exemplary embodiment.
Figure 13:
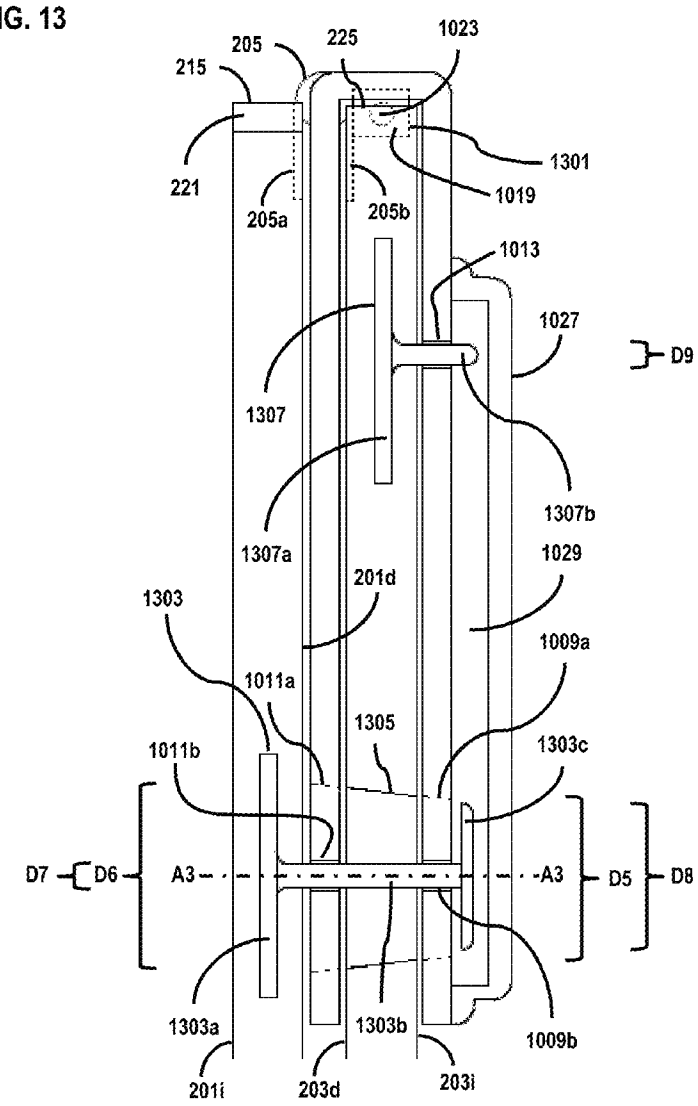
FIG. 13 is a sectional view of the foldable auxiliary vessel of FIG. 2 taken along is sectional line XIII-XIII, according to an exemplary embodiment.

FIG. 2 is a plan view of a foldable auxiliary vessel (or vessel) 200, according to an exemplary embodiment. It is noted that FIGS. 3-5 respectively provide front, rear, and side elevation views of vessel 200, whereas FIGS. 6, 7, and 13 provide various sectional views of vessel 200 taken along sectional lines VI-VI, VII-VII, and XIII-XIII, respectively. As shown, vessel 200 includes a first (e.g., starboard) hull portion 201 and a second (e.g., port) hull portion 203 that, according to exemplary embodiments, may be movably interconnected so as to enable hull portion 201 and/or hull portion 203 to rotate about a longitudinally extending imaginary axis A1 parallel (or substantially parallel) to an imaginary X-axis. For instance, hull portions 201 and 203 may be moveably interconnected via corresponding male and female components (not shown) of one or more hinge assemblies, such as hinge assemblies 205 and 207, that longitudinally extend along portions of corresponding outer edges 209 and 211 of hull portions 201 and 203, respectively. In this manner, hull portion 201 may be rotated atop hull portion 203 (or vice versa) to define an enclosed interior cavity region (or environment), as seen in FIG. 1.

According to one embodiment, hull portion 201 has a shell-like structure including a plurality of exterior surfaces 201*a*, 201*b*, 201*c*, 201*d*, and 201*e* that substantially is enclose an interior cavity region 213 having inner surfaces 201*f*, 201*g*, 201*h*, 201*i*, and 201*j*. In this manner, exterior surfaces 201*a*-201*d* and interior surfaces 201*f*-201*i* terminate at corresponding edges, which together form peripheral (or gunwale) surface 215 of hull portion 201. Peripheral surface 215 defines a bounding edge of an opening to interior cavity region 213, as well as includes a plurality of recessed portions, such as recessed portions 217, 219, and 221. Similarly, hull portion 203 may have a shell-like structure including a plurality of exterior surfaces 203*a*, 203*b*, 203*c*, 203*d*, and 203*e* that substantially enclose an interior cavity region 223 having inner surfaces 203*f*, 203*g*, 203*h*, 203*i*, and 203*j*. As such, exterior surfaces 203*a*-203*d* and interior surfaces 203*f*-203*i* terminate at corresponding edges, which together form peripheral (or gunwale) surface 225 of hull portion 203. Peripheral surface 225 defines a bounding edge of an opening to interior cavity region 223, as well as includes a plurality of recessed portions, such as recessed portions 227 and 229. It is noted that recessed portions 217 and 227 are longitudinally offset from one another, as may be recessed portions 219 and 229. Thus, when vessel 200 is in the open configuration illustrated in FIG. 2, outer surfaces 201*a* and 203*a* define a bow of vessel 200, whereas outer surfaces 201*c* and 203*c* define a stern of vessel 200. Further, outer surfaces 201*b* and 203*b* respectively define a starboard surface and a port surface of vessel 200.

As seen in FIGS. 2-5, hull portion 201 longitudinally extends from an imaginary transverse plane P1 coincident with apex 231 of outer surface 201*a* to an imaginary transverse plane P2 coincident with apex 233 of outer surface 201*c*. Likewise, hull portion 203 longitudinally extends from imaginary transverse plane P1 coincident with apex 231 of outer surface 203*a* to imaginary transverse plane P2 coincident with apex 233 of outer surface 203*c*. It is noted that outer surface 201*a* may be hydrodynamically contoured between imaginary is transverse plane P1 and imaginary transverse plane P3, as well as hydrodynamically contoured between outer surfaces 201*e* and 215. Similarly, outer surface 203*a* may be hydrodynamically contoured between imaginary transverse plane P1 and imaginary transverse plane P3, as well as hydrodynamically contoured between outer surfaces 203*e* and 225. Outer surfaces 201*b* and 203*b* may be hydrodynamically contoured between imaginary transverse plane P3 and imaginary transverse plane P4, as well as hydrodynamically contoured between an imaginary plane P6 and imaginary plane P7. Outer surfaces 201*c* and 203*c* may be hydrodynamically contoured between imaginary transverse plane P2 and imaginary transverse plane P5. Further, outer surfaces 201*e* and 203*e* may be hydrodynamically contoured been imaginary plane P7 and imaginary plane P8. It is noted that the contouring of outer surfaces 201*e* and 203*e* enable, when vessel 200 is in a closed configuration and outer surface 201*e* is above outer surface 203*e* (or vice versa), water incident upon either outer surface 201*e* or outer surface 203*e* to roll away from primary vessel 103 and off vessel 200.

It is noted that when vessel 200 is placed in water, weight acting toward a center of hull portion 201 and/or 203 will tend to force hull portions 201 and 203 apart at corresponding keel portions 235 and 237 and together at outer edges 209 and 211. That is, when vessel 200 is placed in water, buoyant forces applied at the longitudinal outer limits of hull portions 201 and 203 will place vessel 200 under a bending moment, thereby applying compressive forces at outer edges 209 and 211 and tensile forces at keel portions 235 and 237. In this manner, an imaginary neutral axis A2 extends longitudinally through vessel 200 where vessel 200 is neither in compression nor tension. To counteract the tendency of hull portions 201 and 203 to separate at corresponding keel portions 235 and 237, hull portions 201 and 203 may be secured above, below, or at a designed waterline WL via, for instance, locking mechanism 239, which may be is actuated between locked state 241 and unlocked state 243 via, for example, locking mechanism actuator (actuator) 245. Locking mechanism 239 is described in more detail in association with FIGS. 10-13. Actuator 245 is more fully explained in conjunction with FIG. 14.

With continued reference to FIGS. 2-5, vessel 200 also includes a plurality of capture brackets, such as capture brackets 251, 253, 255, and 257, integrally formed from (or otherwise secured to) corresponding outer surfaces 201*b* and 203*b*. As will become more apparent below, capture brackets 251-257 enable vessel 200 to be moored to primary vessel 103 in one or more states, such as illustrated in FIGS. 1, 29-32, and 34. It is noted that capture brackets 251 and 253 may be respectively aligned with recessed portions 227 and 229, whereas capture brackets 255 and 257 may be respectively aligned with recessed portions 217 and 219. An exemplary capture bracket is more full explained in conjunction with FIGS. 15-17.

Figure 9:
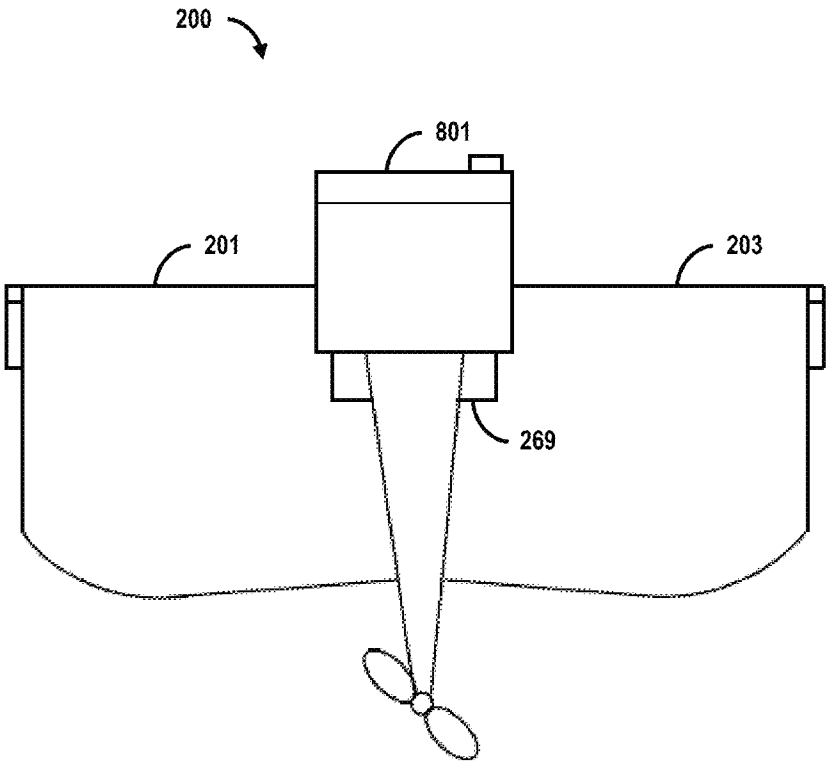
FIG. 9 is a rear elevation view of the foldable auxiliary vessel of FIG. 2 equipped with an outboard propulsion device, according to an exemplary embodiment.
Figure 8:
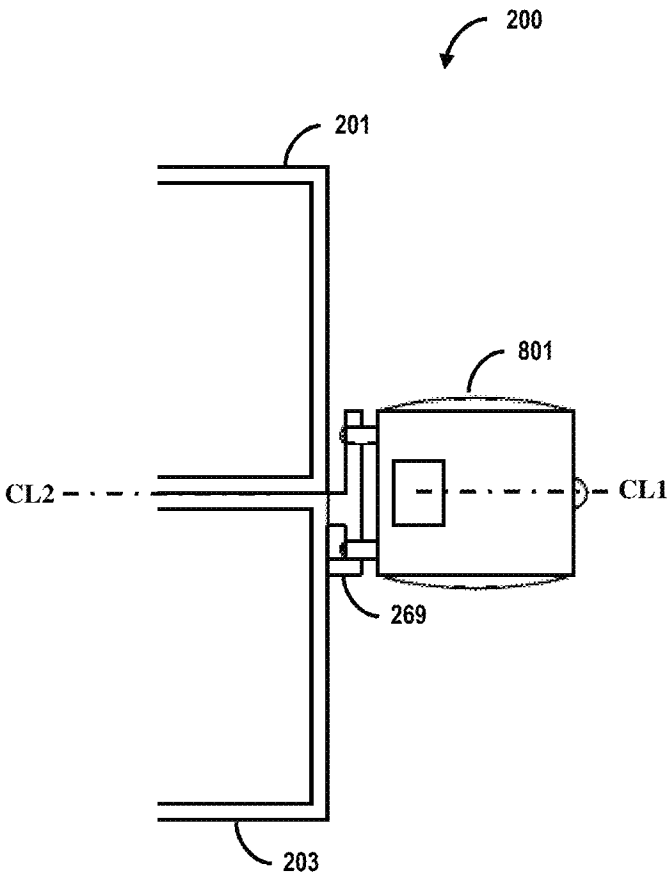
FIG. 8 is partial plan view of the foldable auxiliary vessel of FIG. 2 equipped with an outboard propulsion device, according to an exemplary embodiment.

According to various embodiments, vessel 200 further includes one or more thwarts (or seats), such as thwarts 259, 261, 263, and 265, integrally formed from (or otherwise secured to) corresponding hull portions 201 and 203. Thwarts 259-265 may include lower portions having positive floatation material 267 disposed therein. In certain implementations, vessel 200 may also have an outboard propulsion device bracket (bracket) 269 detachably coupled to either hull portion 201 or hull portion 203. As shown in FIG. 2, bracket 269 is detachably coupled to hull portion 203 via auxiliary vessel coupling portions 269*a* and 269*b*. It is noted that portions 269*a* and 269*b* may include one or more mounting bores (not shown) that enable bracket 269 to be, for instance, fastened (e.g., screwed, bolted, pinned, etc.) to vessel 200. Bracket 269 further includes propulsion device coupling portion 269*c* configured to enable at least one outboard propulsion device to be detachably coupled to vessel 200. In this manner, portion 269*c* may include one or more mounting bores (not illustrated) that enable at least one is outboard propulsion device to be, for example, fastened to bracket 269. Adverting momentarily to FIGS. 8 and 9, an exemplary outboard propulsion device 801 is shown detachably coupled to bracket 269. Bracket 269 via coupling portion 269*c* enables outboard propulsion device 801 to be detachably coupled to vessel 200 with its centerline CL1 being aligned (or substantially aligned) with centerline C2 of vessel 200. It is further noted that since bracket 269 is only attached to either hull portion 201 or hull portion 203, when vessel 200 is actuated between an open configuration (as illustrated in FIG. 2) and a closed configuration (as shown in FIG. 1), outboard propulsion device 801 need not be removed from vessel 200, as bracket 269 enables outboard propulsion device 801 to remain properly oriented and secured to vessel 200.

Figure 10:
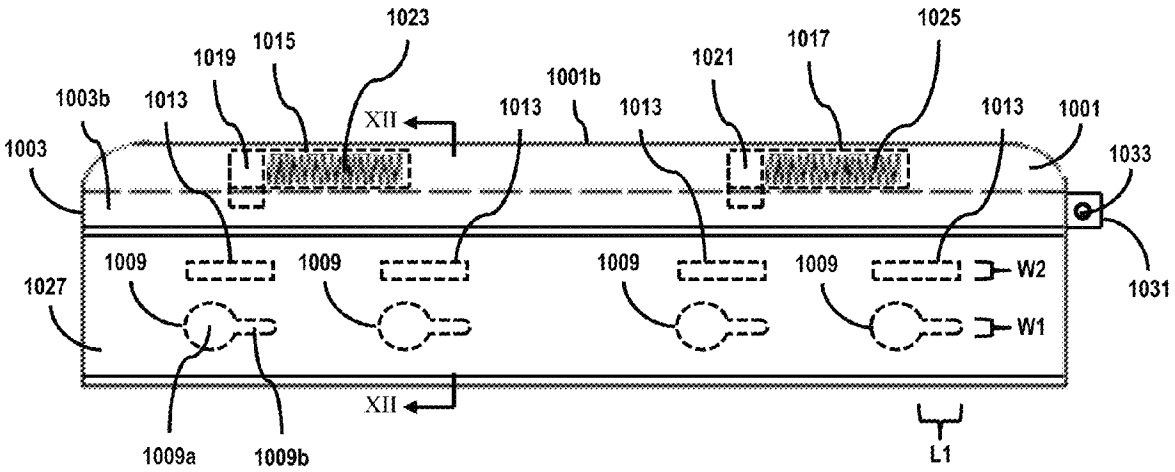
FIG. 10 is a side elevation view of a locking mechanism of a foldable auxiliary vessel, according to an exemplary embodiment.
Figure 11:
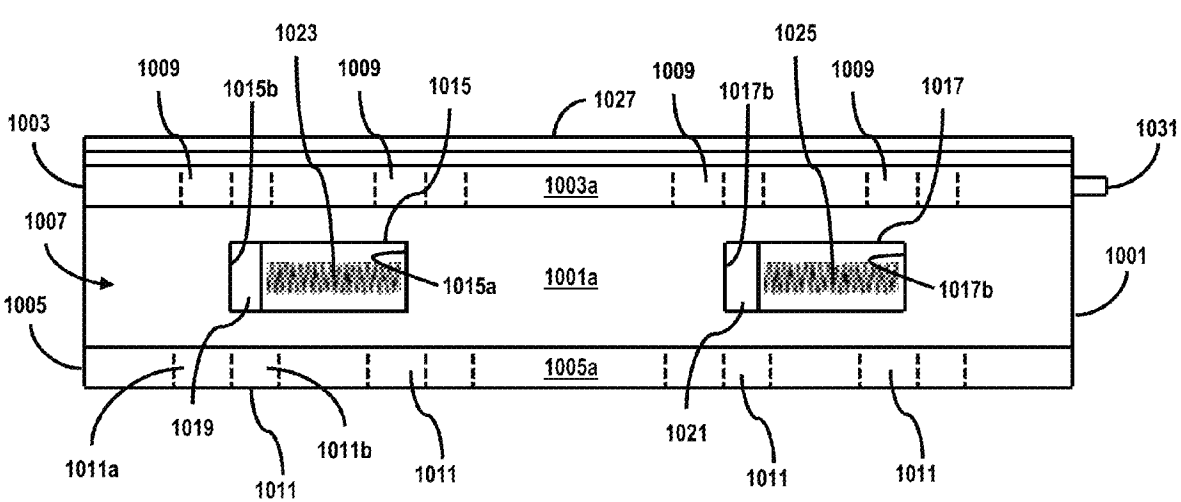
FIG. 11 is a plan view of the locking mechanism of FIG. 10, according to an exemplary embodiment.
Figure 12:
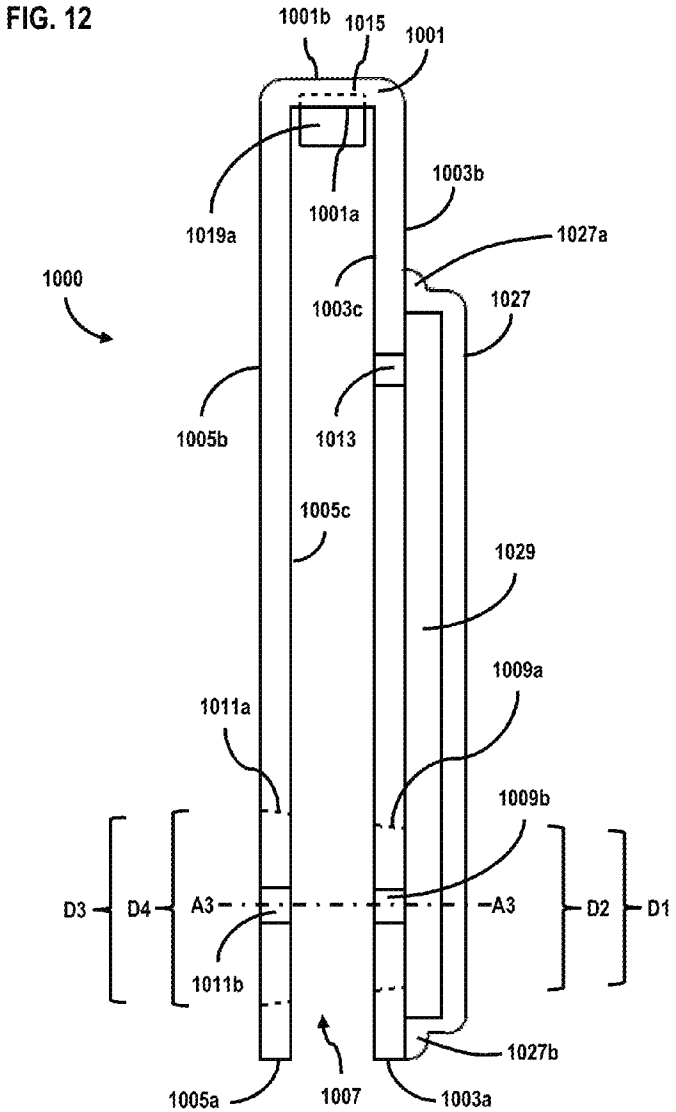
FIG. 12 is a sectional view of the locking mechanism of FIG. 10 taken along sectional line XII-XII, according to an exemplary embodiment.

FIGS. 10 and 11 are, respectively, a side elevation view and a plan view of a locking mechanism of a foldable auxiliary vessel, according to an exemplary embodiment. FIG. 12 is a sectional view of the locking mechanism taken along sectional line XII-XII. As shown, locking mechanism 1000 substantially forms an inverted "U" shape having main body portion 1001 from which flanges 1003 and 1005 integrally extend therefrom and, thereby, define slotted region 1007 therebetween. Slotted region 1007 extends from lower surface 1001*a* of body portion 1001 to lower surfaces 1003*a* and 1005*a* of flanges 1003 and 1005, respectively. Flange 1003 includes a plurality of slotted bores 1009 including corresponding main bore regions 1009*a* having respective slot regions 1009*b* extending therefrom. Main bore regions 1009*a* may, in exemplary embodiments, be conically-defined. That is, corresponding diameters of main bore regions 1009*a* may vary (such as linearly vary) from a first diameter D1 to a second diameter D2, where D2 is dimensionally greater than D1. In this manner, slotted bores 1009 extend from surface 1003*b* to surface 1003*c* and, thereby, extend into slotted region 1007. Similarly, flange 1005 includes a plurality of slotted bores 1011 including corresponding main bore regions 1011*a* is having respective slot regions 1011*b* extending therefrom. Main bore regions 1011*a* may be conically-defined and, thereby, include corresponding diameters varying (such as linearly varying) from a third diameter D3 to a fourth diameter D4, with D4 being dimensionally greater than D3. It is noted that, in exemplary embodiments, D3 is dimensionally greater than D2. In this manner, slotted bores 1011 may extend from surface 1005*b* to surface 1005*c* and, thereby, extend into slotted region 1007. According to one embodiment, respective slot regions 1009*b* and 1011*b* may have uniform slot widths W1 extending along slot lengths L1. While not illustrated, slot widths W1 may alternatively narrow (such as linearly narrow) along slot length L1 from a first slot width to a second slot width, with the first slot width being dimensionally larger than the second slot width, the first slot width being defined at an interface between corresponding main bore regions 1009*a* and 1011*a* and respective slot regions 1009*b* and 1011*b*. It is further noted that opposing main bore regions 1009*a* and 1011*a* on respective flanges 1003 and 1005 may be concentrically aligned along corresponding imaginary axes A3, such as seen in FIG. 12. Flange 1003 may further include a plurality of slots 1013 extending from surface 1003*b* to surface 1003*c* and, thereby into slotted region 1007.

According to various embodiments, main body portion 1001 includes one or more recessed regions, such as recessed regions 1015 and 1017, extending into surface 1001*a* towards surface 1001*b*. Recessed regions 1015 and 1017 correspondingly include guide members 1019 and 1021, which may interface with, for instance, one or more dovetail tracked surfaces (not shown) formed within recessed regions 1015 and 1017. It is noted that respective portions of corresponding guide members 1019 and 1021 extend into slotted region 1007, such as portion 1019*a* of guide member 1019. Adverting momentarily to FIG. 13, these respective portions of guide members 1019 and 1021 are configured to engage one or more corresponding recessed is regions formed within peripheral surface 225 of hull portion 203 and, thereby, couple locking mechanism 1000 to hull portion 203. For example, portion 1019*a* of guide member 1019 is configured to engage recessed region 1301 of hull portion 203. Alternatively, guide members 1019 and 1021 may be protrusions integrally formed from peripheral surface 225 that respectively extend into recessed regions 1015 and 1017, respectively. In either case, however, when locking mechanism 1000 is caused, at least in part, to be actuated between locked state 241 and unlocked state 243, guide members 1019 and 1021 will be held stationary with respect to hull portion 203, but caused to be displaced (e.g., slid) within recessed regions 1015 and 1017. According to certain embodiments, guide members 1019 and 1021 may be respectively biased from inner surfaces 1015*a* and 1017*a* towards corresponding inner surfaces 1015*b* and 1017*b* via respective biasing members 1023 and 1025. As such, locking mechanism 1000 may be biased towards locked state 241.

Adverting to FIG. 13, locking mechanism 1000 via slotted bores 1009 and 1011 is configured to slideably engage and disengage a plurality of locking pins 1303 extending from hull portion 201 through hull portion 203 via a plurality of through bores 1305. Locking pins 1303 include head portions 1303*a* embedded within hull portion 201, such as between outer surface 201*d* and inner surface 201*i*. Shaft portions 1303*b* extend from head portions 1303*a* and, thereby, protrude from outer surface 201*d*. In one embodiment, diameter D7 of corresponding shaft portions 1303*b* is dimensionally smaller than width W1 of respective slot regions 1009*b* and 1011*b* so that corresponding shaft portions 1303*b* may be received within respective slot regions 1009*b* and 1011*b* when locking mechanism 1000 is in locked state 241. Shaft portions 1303*b* terminate at corresponding head portions 1303*c* of diameter D8, where D8 is dimensionally smaller than D1, but dimensionally larger than D7.

According to various embodiments, through bores 1305 are conically-defined and, thereby, include diameters varying (such as linearly varying) from corresponding fifth diameters D5 to corresponding sixth diameters D6, where D6 is dimensionally greater than D5. It is noted that D5 may be dimensionally greater than or equal to D2, and D3 may be dimensionally greater than or equal to D6. Thus, when locking mechanism 1000 is in unlocked state 243 and vessel 200 is in the open configuration of FIG. 2, respective ones of through bores 1305 will be concentrically aligned with main bore regions 1009*a* and 1011*a*, such as concentrically aligned with corresponding imaginary axes A3. In this manner, corresponding locking pins 1303 will be enabled to protrude from outer surface 201*d* of hull portion 201, pass through respective main bore portions 1011*a*, traverse respective through bores 1305, and pass through respective main bore portions 1009*a*. When locking mechanism 1000 is toggled from unlocked state 243 to locked state 241, corresponding shaft portions 1303*b* will be received in slotted regions 1009*b* and 1011*b*. Since diameter D8 of respective locking pins 1303 is dimensionally greater than corresponding widths W1 of slotted regions 1009*b* and 1011*b*, locking pins 1303 will be prevented from passing through slotted bores 1009 and 1011. As such, vessel 200 will be prevented from moving to the closed configuration of FIG. 1.

Locking mechanism 1000 via slots 1013 also engages a plurality of guide pins 1307 extending from hull portion 203. Guide pins 1307 include head portions 1307*a* embedded within hull portion 203, such as between outer surface 203*d* and inner surface 203*i*. Shaft portions 1307*b* extend from head portions 1307*a* and, thereby, protrude from inner surface 203*i*. In one embodiment, diameter D9 of corresponding shaft portions 1307*b* is dimensionally smaller than respective widths W2 of slots 1013 so that corresponding shaft portions 1307*b* may be received within corresponding slots 1013 as locking mechanism 1000 is toggled between locked is state 241 and unlocked state 243. In order to conceal corresponding distal ends of locking pins 1303 and guide pins 1307, locking mechanism 1000 may also include face plate 1027 having extension portions 1027*a* and 1027*b* enabling face plate 1027 to be secured to surface 1003*b*, yet create interior cavity region 1029 configured to enable distal end portions of locking pins 1303 and guide pins 1307 to be received and move therein.

Figure 14:
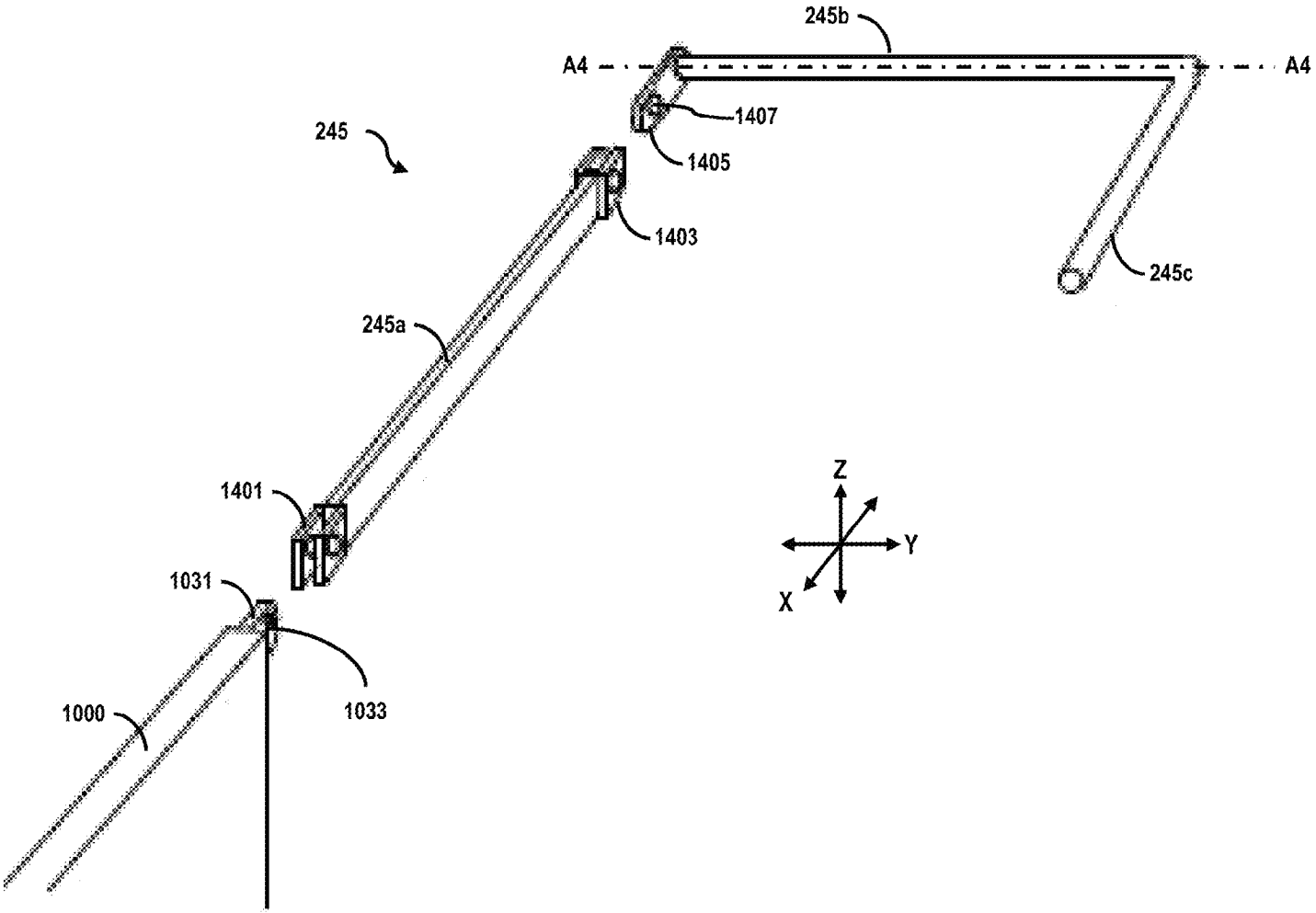
FIG. 14 is an isometric view of a locking mechanism actuator, according to an exemplary embodiment.

Locking mechanism 1000 further includes attachment flange 1031 having attachment bore 1033 configured to enable locking mechanism actuator 245 to be coupled thereto, such as pinned thereto. FIG. 14 is an isometric view of a locking mechanism actuator, according to an exemplary embodiment. With continued reference to FIG. 2, locking mechanism actuator (or actuator) 245 may include translation portion 245*a*, rotation portion 245*b*, and manipulation portion 245*c*. Translation portion 245*a* includes devises 1401 and 1403 configured to enable translation portion 245*a* to be coupled to locking mechanism 1000 at a first distal end and coupled to rotation portion 245*b* at a second distal end via corresponding clevis pins (not illustrated). According to one embodiment, translation portion 245*a* is slideably secured to inner surface 203*i* via constraint 247 that enables translation portion 245*a* to be displaced (or otherwise translated) in an imaginary X-Z plane. Rotation portion 245*b* includes attachment flange 1405 having attachment bore 1407 configured to enable rotation portion 245*b* to be coupled to translation portion 245*a* via clevis 1403 and the corresponding clevis pin (not shown). Rotation portion 245*b* is rotationally secured to inner surface 203*h* via constraint 249 that enables rotation portion 245*b* to be rotated about an imaginary axis of rotation A4.

Manipulation portion 245*c* extends from rotation portion 245*b* and may be rotated about imaginary axis of rotation A4 to cause, at least in part, locking mechanism 1000 to be actuated between states 241 and 243. In other words, when manipulation portion 245*c* is caused is to be rotated about imaginary axis of rotation A4 in a first direction (e.g., a clockwise direction), rotation portion 245*b* will also rotate about imaginary axis of rotation A4, which causes, at least in part, translation portion 245*a* to be displaced towards a stern of vessel 200 and locking mechanism 1000 to be actuated from locked state 241 to unlocked state 243. Accordingly, when manipulation portion 245*c* is caused to be rotated about imaginary axis of rotation A4 in a second direction (e.g., a counterclockwise direction), rotation portion 245*b* will also rotate about imaginary axis of rotation A4, which causes, at least in part, translation portion 245*a* to be displaced towards a bow of vessel 200 and locking mechanism 1000 to be actuated from unlocked state 243 to locked state 241. It is also noted that manipulation portion 245*c* may be utilized to toggle vessel 200 from the open configuration illustrated in FIG. 2 to the closed configuration of FIG. 1. Namely, rotating manipulation portion 245*c* about imaginary axis of rotation A1 causes, at least in part, hull portion 203 to be rotated atop hull portion 201 to define the enclosed interior cavity region seen in FIG. 1.

Figure 15:
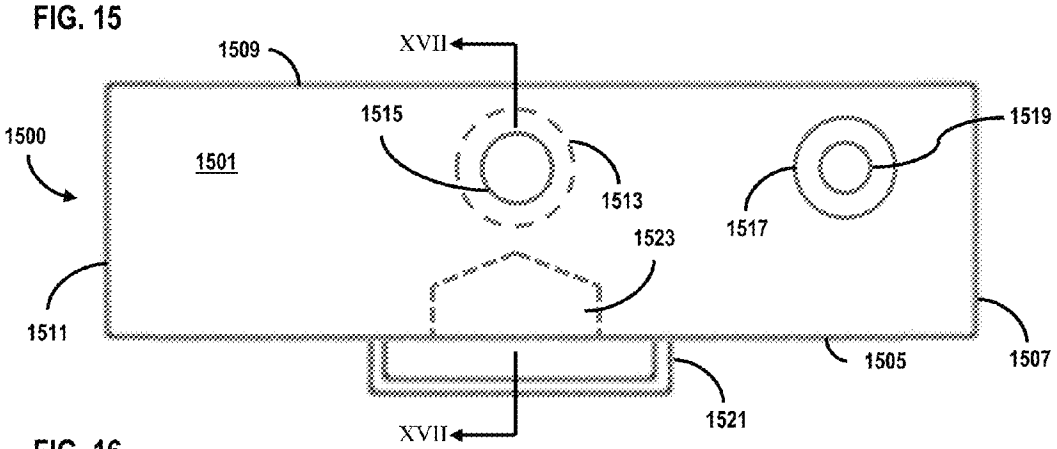
FIG. 15 is a plan view of a capture bracket of a foldable auxiliary vessel, according to an exemplary embodiment.
Figure 16:
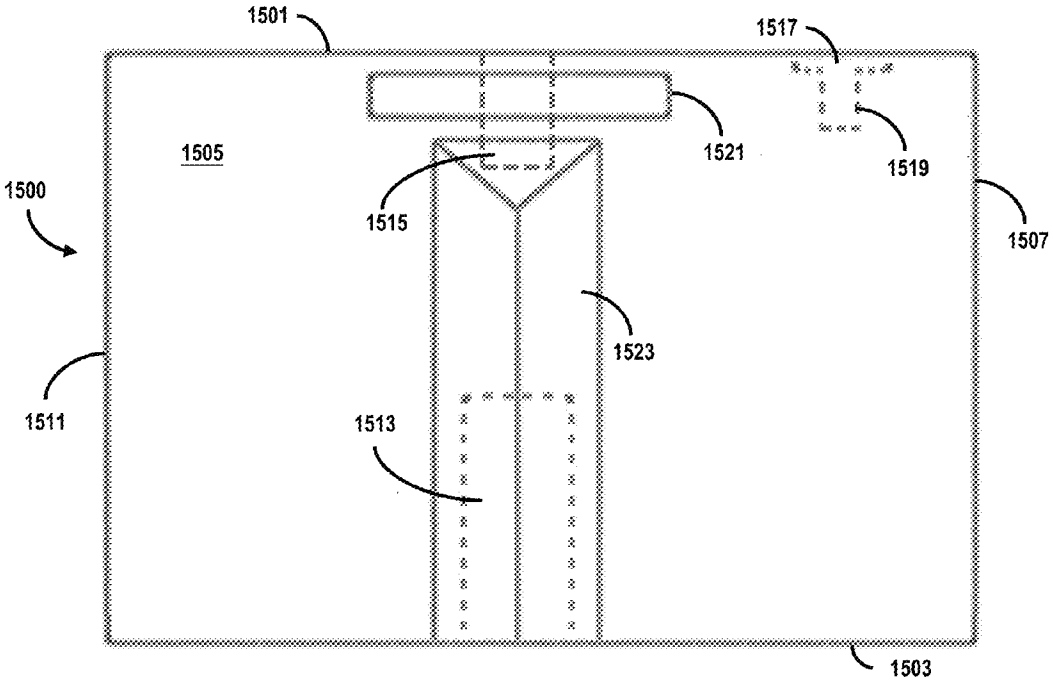
FIG. 16 is a side elevation view of the capture bracket of FIG. 15, according to an exemplary embodiment.
Figure 17:
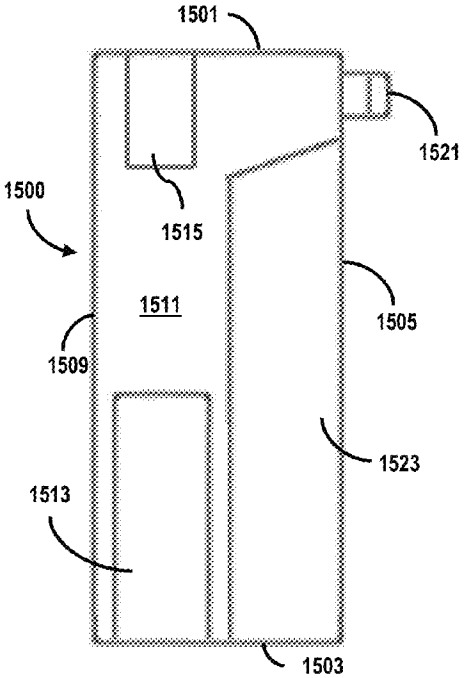
FIG. 17 is a sectional view of the capture bracket of FIG. 15 taken along sectional line XVII-XVII, according to an exemplary embodiment.

FIG. 15 is a plan view of a capture bracket of a foldable auxiliary vessel, according to an exemplary embodiment. It is noted that FIG. 16 is a side elevation view of the capture bracket, whereas FIG. 17 is a sectional view of the capture bracket taken along sectional line XVII-XVII. As shown in the illustrated embodiment, capture bracket (or bracket) 1500 includes upper surface 1501, lower surface 1503, and a plurality of side surfaces 1505, 1507, 1509, and 1511. It is noted that one or more brackets 1500 may be integrally formed from at least a portion of vessel 200, such as integrally formed from at least respective portions of outer surfaces 201*b* and 203*b* of vessel 200. Alternatively (or additionally) the one or more brackets 1500 may be detachably coupled to outer surfaces 201*b* and 203*b* via, for example, one or more securing means (not shown), such as one or more bolts, screws, etc. Bracket 1500 further is includes a first blind bore 1513 extending from lower surface 1503 towards upper surface 1501, as well as a second blind bore 1515 extending from upper surface 1501 towards lower surface 1503.

As will become more apparent below, blind bore 1513 is configured to slideably receive at least a portion of a lifting mechanism of an auxiliary vessel storing and deploying mechanism (such as storing and deploying mechanism 2200 of FIG. 22), whereas blind bore 1515 is configured to slideably receive at least a portion of a securing mechanism of the auxiliary vessel storing and deploying mechanism. Socket 1517, including attachment blind bore 1519, may be securely embedded in upper surface 1501 of bracket 1500 to enable at least a portion of an oarlock (not shown), such as a pivot post of an oarlock, to be detachably coupled to bracket 1500 and, thereby, detachably coupled to vessel 200. Bracket 1500 may also include engagement portion 1521, such as a "D" ring, extending from surface 1505 and configured to enable, for instance, a drawing mechanism of the storing and deploying mechanism to be detachably coupled thereto and, thereby, detachably coupled to vessel 200. According to certain exemplary embodiments, bracket 1500 may further include one or more recessed channels, such as recessed channel 1523, which may be recessed into surface 1505 towards surface 1509. In the illustrated embodiment, recessed channel 1523 is a recessed "V" channel that may be configured to center (or otherwise align) bracket 1500 with at least a portion of the storing and deploying mechanism, which will be more fully described below.

Figure 18:
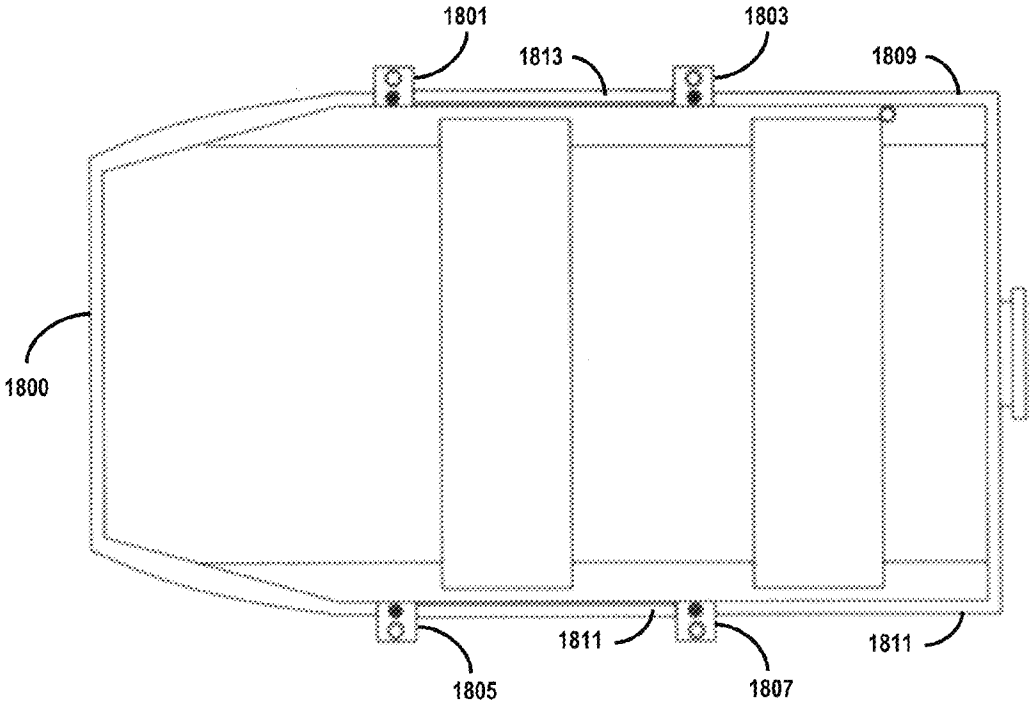
FIG. 18 is a plan view of a conventional auxiliary vessel equipped with a plurality of retro-fit brackets, according to an exemplary embodiment.
Figure 19:
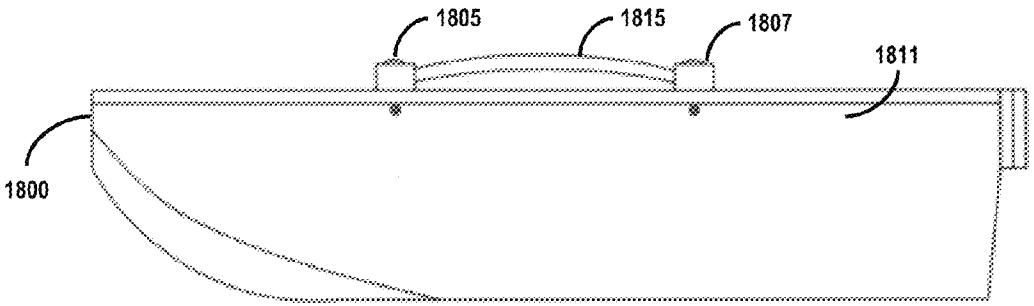
FIG. 19 is a side elevation view of the conventional auxiliary vessel of FIG. 18, according to an exemplary embodiment.
Figure 20:
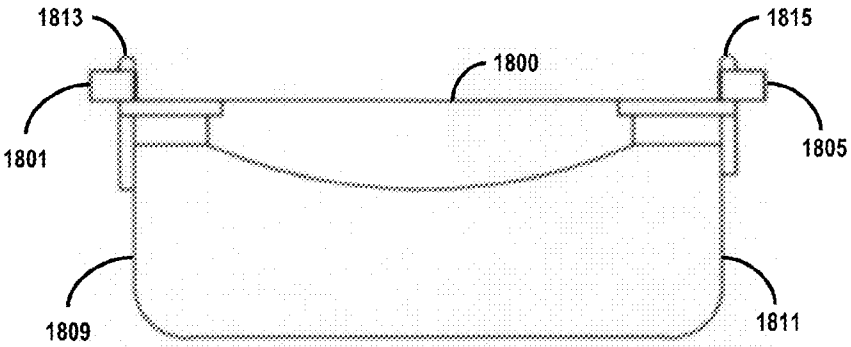
FIG. 20 is a front elevation view of the conventional auxiliary vessel of FIG. 18, according to an exemplary embodiment.

According to alternative embodiments, a conventional auxiliary vessel may be retro-fit with a plurality of retro-fit brackets. FIG. 18 is a plan view of a conventional auxiliary vessel equipped with a plurality of retro-fit brackets, according to an exemplary embodiment. It is noted that FIGS. 19 and 20 respectively provide side and front elevation views of the is conventional auxiliary vessel of FIG. 18. As shown, conventional auxiliary vessel (or vessel) 1800 may include a plurality of retro-fit brackets, such as retro-fit brackets 1801, 1803, 1805, and 1807, detachably coupled thereto. For instance, retro-fit brackets 1801 and 1803 may be detachably coupled to respective portions of hull wall 1809, whereas retro-fit brackets 1805 and 1807 may be detachably coupled to respective portions of hull wall 1811. In one embodiment, retro-fit brackets 1801-1807 may be detachably coupled to hull walls 1809 and 1811 via one or more securing means, such as one or more blots, screws, etc. Further, respective ones of retro-fit brackets 1801-1807 may be interconnected via corresponding handle bars 1813 and 1815 that may, in certain embodiments, be arcuately contoured.

Figure 21:
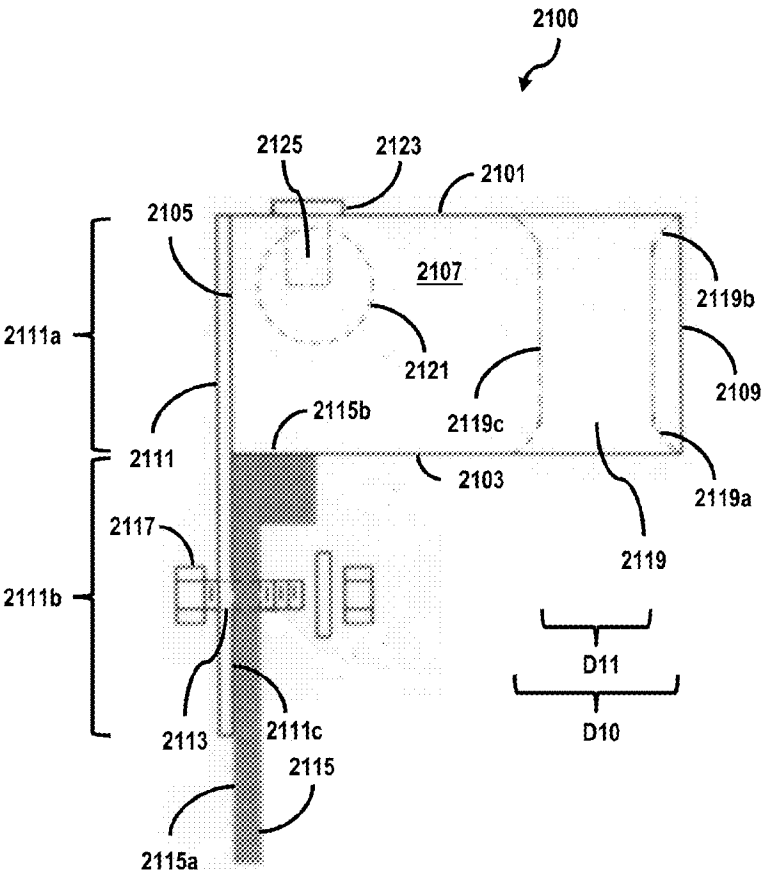
FIG. 21 is a side elevation view of a retro-fit bracket, according to an exemplary embodiment.

Adverting to FIG. 21, a side elevation view of exemplary retro-fit bracket (or bracket) 2100 is illustrated. Bracket 2100 includes upper surface 2101, lower surface 2103, and a plurality of side surfaces, such as side surfaces 2105, 2107 and 2109. At least a portion of a first region 2111*a* of mounting plate 2111 may be coupled to at least a portion of side surface 2105 of bracket 2100. A second region 2111*b* of mounting plate 2111 may extend for a predetermined distance beyond lower surface 2103. Second region 2111*b* includes at least one mounting bore 2113 to enable bracket 2100 to be detachably coupled to hull wall 2115 of a conventional auxiliary vessel, such as vessel 1800, via one or more securing means, such as bolt 2117. In this manner, when bracket 2100 is detachably coupled to hull wall 2115, surface 2111*c* of mounting plate 2111 may abut inner surface 2115*a* of hull wall 2115. Further, at least a portion of lower surface 2103 may abut at least a portion of gunwale surface 2115*b* of hull wall 2115.

According to various embodiments, bracket 2100 may include a first engagement bore 2119 extending from upper surface 2101 to lower surface 2103, as well as a second is engagement bore 2121 extending from side surface 2107 towards another side surface (not shown). Second engagement bore 2121 may be configured to receive at least a portion, e.g., a distal end, of a handle bar, such as handle bar 1813 or 1815. Similarly to blind bore 1513, first engagement bore 2119 may be configured to slideably receive at least a portion of a lifting mechanism of an auxiliary vessel storing and deploying mechanism, such as storing and deploying mechanism 2200 of FIG. 22. Like blind bore 1515, first engagement bore 2119 may also be configured to slideably receive at least a portion of a securing mechanism of the auxiliary vessel storing and deploying mechanism. In certain embodiments, first engagement bore 2119 may include portions 2119*a* and 2119*b* having varying (e.g., linearly varying) diameters, such as respective diameters varying from D10 to D11, with D10 being dimensionally greater than D11. First engagement bore 2119 may further include portion 2119*c* of uniform diameter D11.

Bracket 2100 may also include socket 2123, having attachment blind bore 2125, securely embedded in upper surface 2101 to enable at least a portion of an oarlock (not shown), such as a pivot post of an oarlock, to be detachably coupled to bracket 2100. While not illustrated, bracket 2100 may also include an engagement portion similar to engagement portion 1521 extending from surface 2109 and configured to enable, for instance, a drawing mechanism of the storing and deploying mechanism to be detachably coupled thereto. In certain embodiments, bracket 2100 may additionally include one or more recessed channels similar to recessed channel 1523 that are configured to center (or otherwise align) bracket 2100 with at least a portion of the storing and deploying mechanism.

Figure 23:
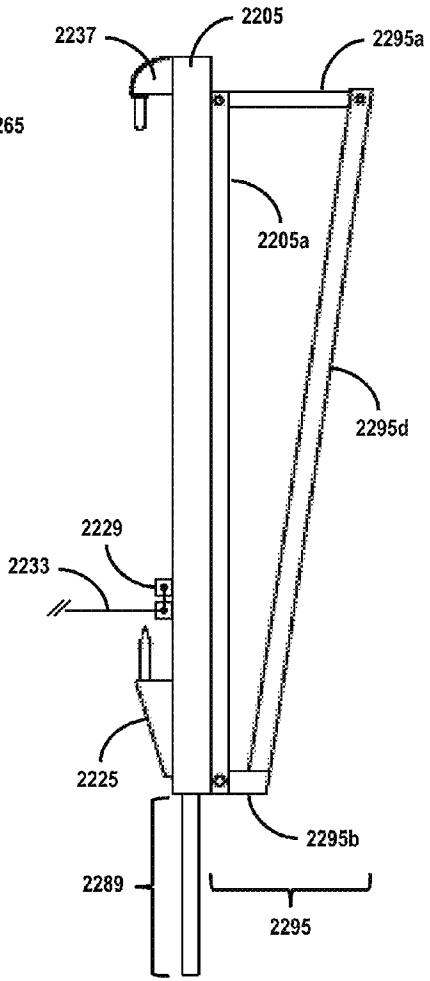
FIG. 23 is a side elevation view of the auxiliary vessel storing and deploying mechanism of FIG. 22, according to an exemplary embodiment.
Figure 22:
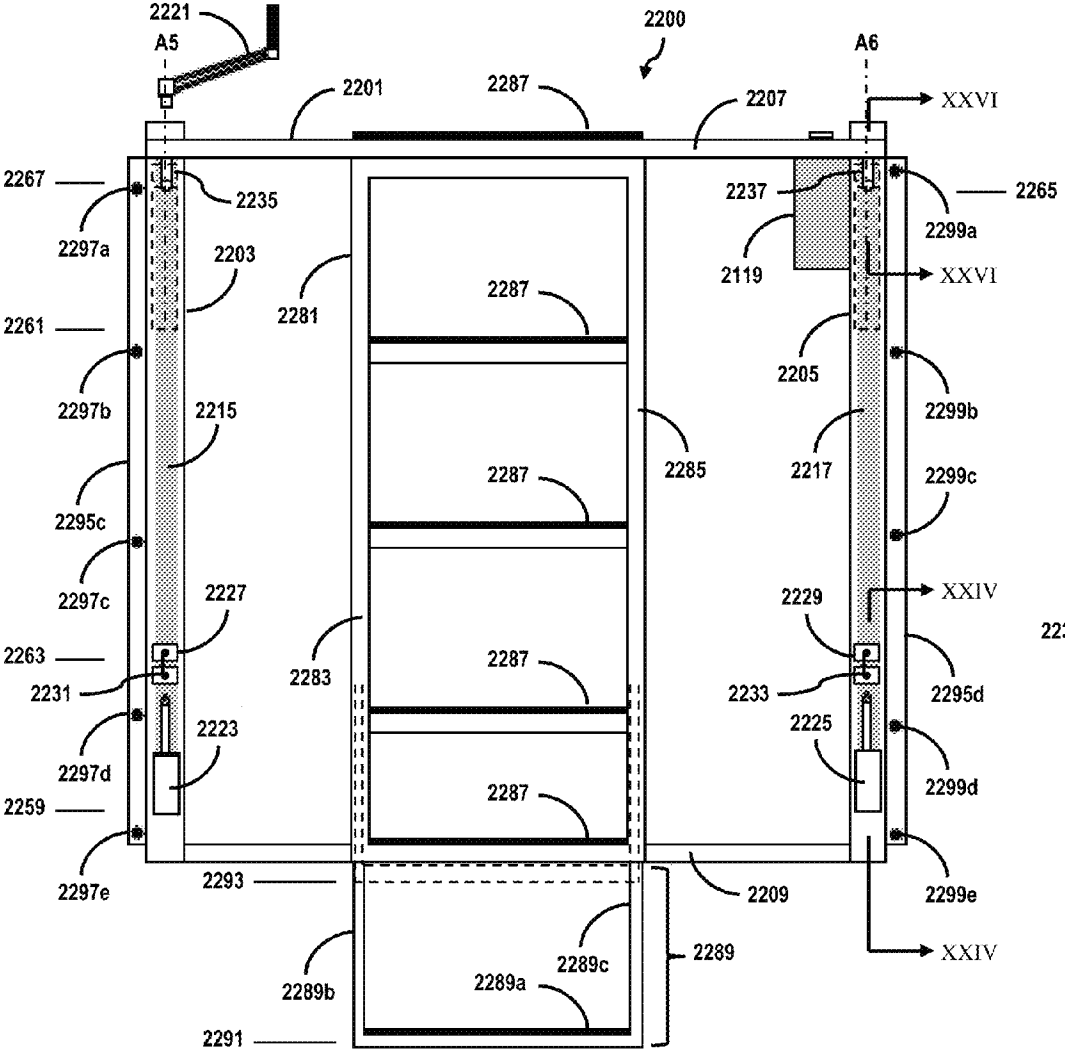
FIG. 22 is an elevation view of an auxiliary vessel storing and deploying mechanism, according to an exemplary embodiment.
Figure 25:
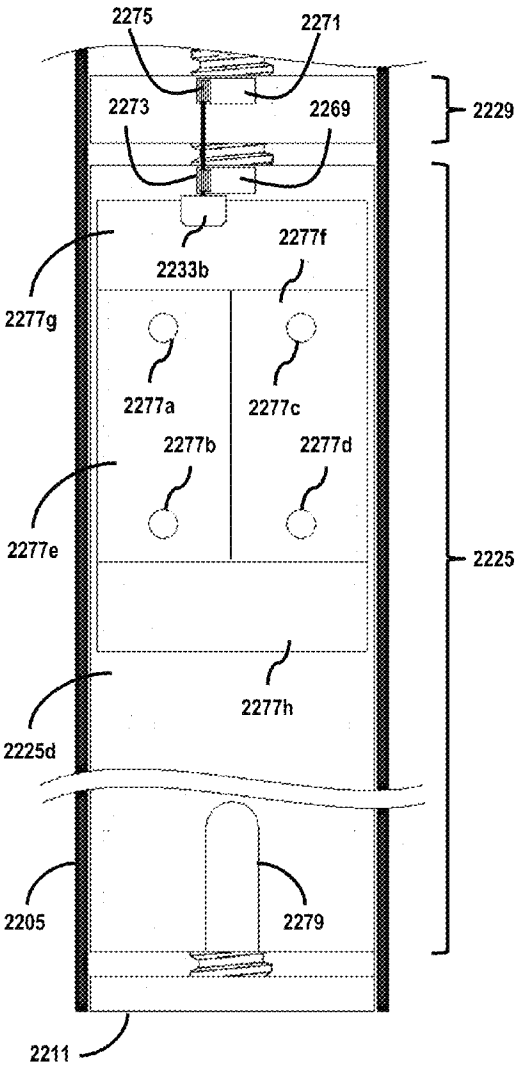
FIG. 25 is a partial elevation view of the auxiliary vessel storing and deploying mechanism of FIG. 22, according to an exemplary embodiment.
Figure 24:
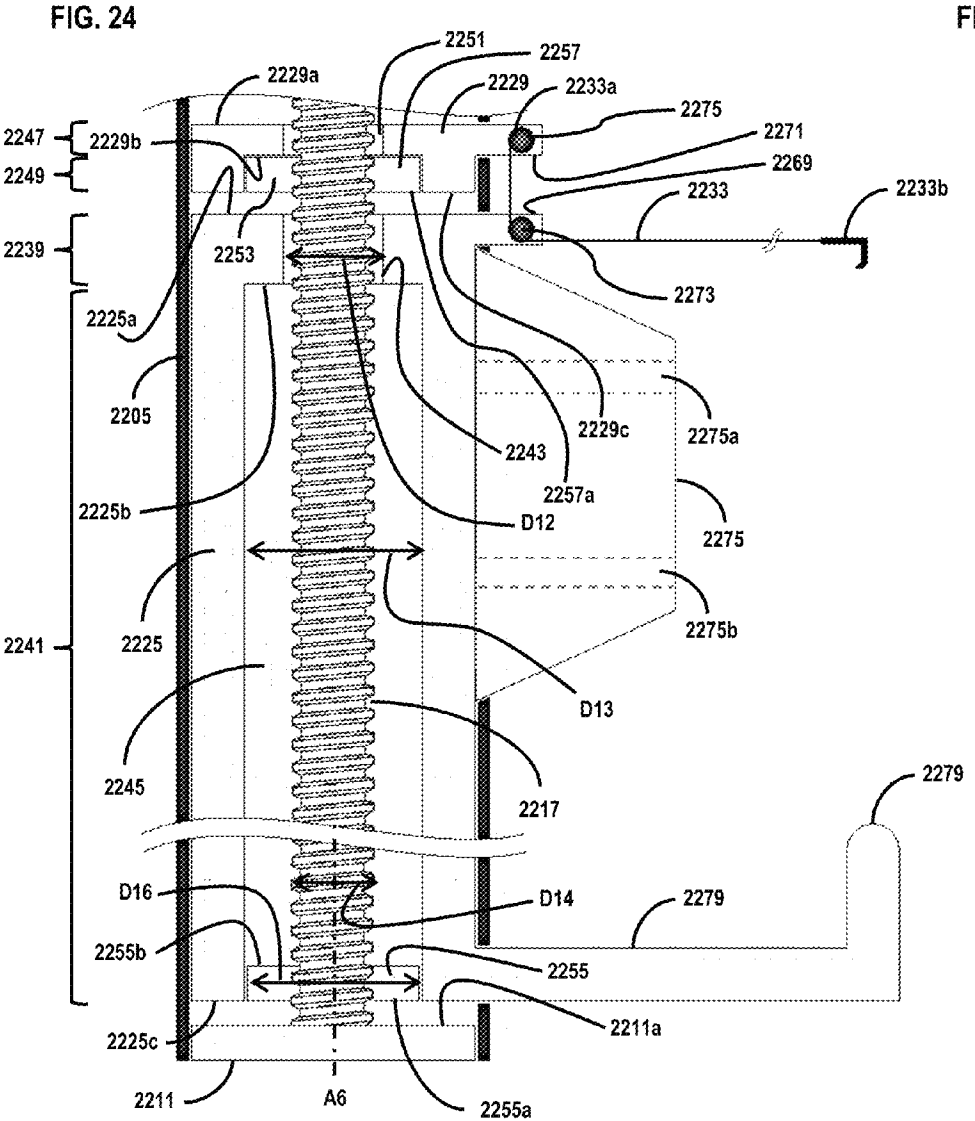
FIG. 24 is a sectional view of the auxiliary vessel storing and deploying mechanism of FIG. 22 taken along sectional line XXIV-XXIV, according to an exemplary is embodiment.
Figure 26:
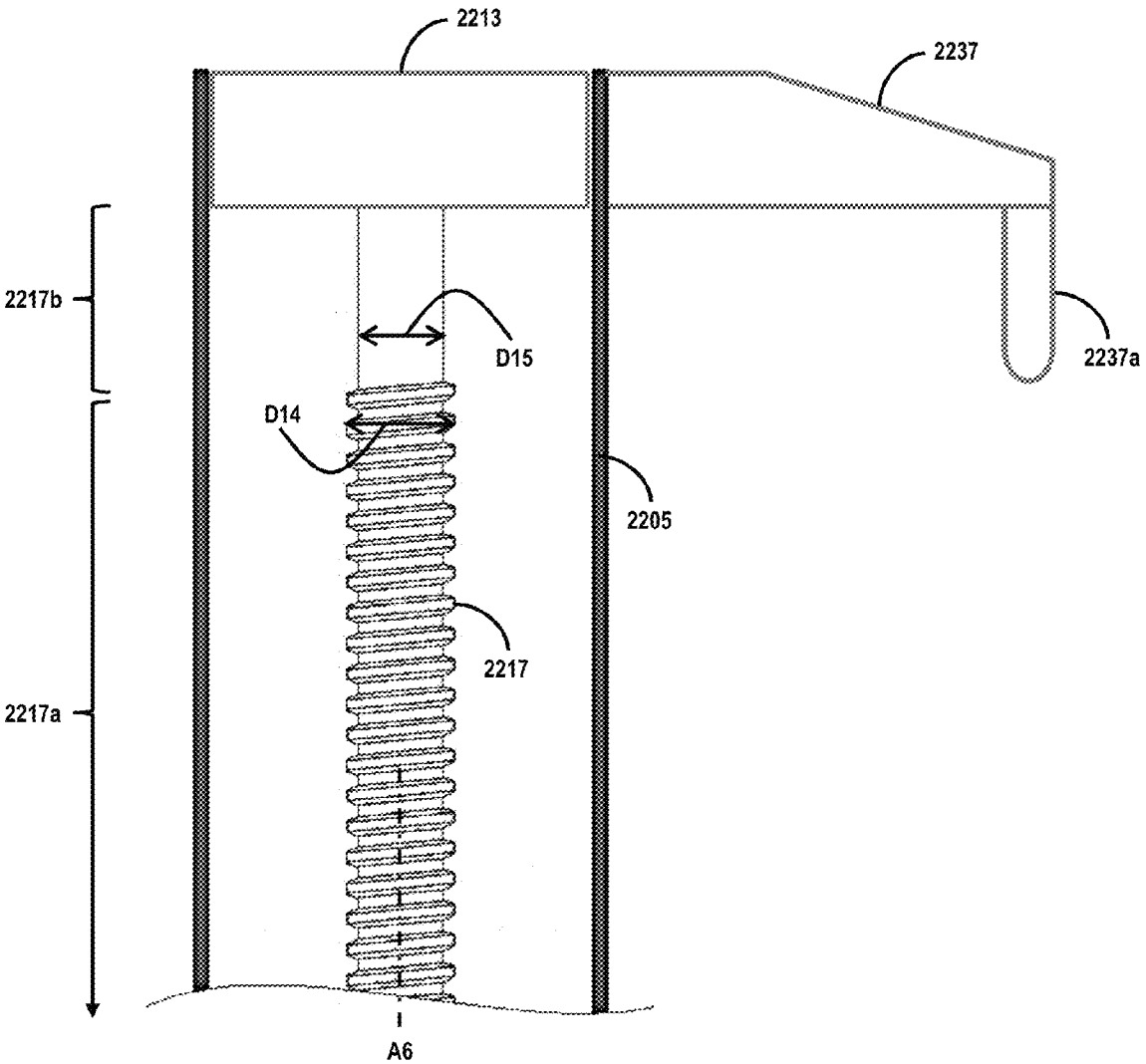
FIG. 26 is a sectional view of the auxiliary vessel storing and deploying mechanism of FIG. 22 taken along sectional line XXVI-XXVI, according to an exemplary embodiment.

FIG. 22 is an elevation view of an auxiliary vessel storing and deploying mechanism (or mechanism) 2200, according to an exemplary embodiment. It is noted that FIGS. 23 and 25 provide side and front elevation views of mechanism 2200, whereas FIGS. 24 and 26 is provide various sectional views of mechanism 2200 taken along sectional lines XXIV-XXIV and XXVI-XXVI, respectively. As shown, mechanism 2200 includes support structure 2201 configured to detachably engage at least a portion of a primary vessel (not shown), such as a transom of a primary vessel. Support structure 2201 includes columns 2203 and 2205 supported via upper frame member 2207 and lower frame member 2209. Columns 2203 and 2205 may be vertically (or substantially vertically) oriented and configured to house a plurality of bearings, such as bearings 2211 and 2213, journaling corresponding ends of respective drive mechanisms 2215 and 2217, which may also be vertically (or substantially vertically) oriented. According to one embodiment, drive mechanisms 2215 and 2217 may be drive screws 2215 and 2217 having corresponding imaginary axes of rotation A5 and A6. While not illustrated, drive screw 2217 has, at an upper end thereof, a pinion that meshes with a corresponding pinion of a reduction gear driven by at least one powered actuator 2219, such as an electric motor, mounted at (or near) a top of column 2205. It is contemplated, however, that powered actuator 2219 may include or otherwise interface with one or more other actuators, such as one or more belt drives, comb drives, chain drives, electroactive polymers, hydraulic mechanisms, motors, pistons, piezoelectric mechanisms, pneumatic mechanisms, relays, step motors, telescopic members, thermal bimorphs, and the like, as well as combinations thereof. Further, one or more controllers (not shown) may be configured to automate actuation of drive mechanisms 2215 and 2217 and/or powered actuator 2219. An exemplary controller is more fully described with FIG. 27.

While not illustrated, input from one or more sensors (or other suitable feedback mechanisms) may be provided to the controller(s) to monitor and facilitate automated actuation of drive mechanisms 2215 and 2217 and/or powered actuator 2219. The sensor(s) may be displaced or otherwise distributed on or within one or more of the various components of is mechanism 2200. As such, sensed conditions (or other feedback information) may be provided to the controller(s) for controlling drive mechanisms 2215 and 2217 and/or power actuator 2219, as well as stored to a memory (not illustrated). Additionally (or alternatively), drive screw 2215 may interface with a wench assembly (not shown) that enables drive screw 2215 to be manually operated via handle 2221 of the wench assembly. In exemplary embodiments, drive screw 2215 is driven at a same angular velocity (or rotational speed about imaginary axes of rotation A5 and A6) as drive screw 2217 via a chain drive, not illustrated. The chain drive may be concealed within an inner cavity region (not shown) of either (or both of) upper frame member 2207 or lower frame member 2209.

According to exemplary embodiments, mechanism 2200 includes lifting mechanisms 2223 and 2225, which are capable of respective displacement along drive screws 2215 and 2217, so as to enable a load, such as vessel 200, supported by (such as cantilevered from) lifting mechanisms 2223 and 2225 to be vertically (or substantially vertically) displaced, e.g., raised and lowered from a horizontal (or substantially horizontal) plane, from a lower position (or first state) to a raised position (or second state). Mechanism 2200 may further include drawing mechanisms 2227 and 2229 that are also capable of respective displacement along drive screws 2215 and 2217. Displacement of drawing mechanisms 2227 and 2229 along drive screws 2215 and 2217 may be configured to cause, at least in part, the load to be displaced (e.g., drawn) towards mechanism 2200 in a horizontal (or substantially horizontal) direction via respective tethering lines 2231 and 2233 correspondingly coupled to drawing mechanisms 2227 and 2229, as will become more apparent below. Columns 2203 and 2205 may, in certain embodiments, also include corresponding engagement portions 2235 and 2237 configured to detachably engage the load when the load is raised to the second state, which is described in is more detail below.

It is noted that the respective arrangements constituting lifting mechanisms 2223 and 2225 are identical, as are the components enabling lifting mechanisms 2223 and 2225 to be displaced along drive screws 2215 and 2217. Similarly, the respective arrangements constituting drawing mechanisms 2227 and 2229 are identical, as are the components enabling drawing mechanisms 2227 and 2229 to be displaced along drive screws 2215 and 2217. Further, the arrangement between lifting mechanism 2223 and drawing mechanism 2227 that enables tethering line 2231 to draw a load, e.g., vessel 200, towards mechanism 2200 is identical to the arrangement between lifting mechanism 2225 and drawing mechanism 2229 that enables tethering line 2233 to draw the load towards mechanism 2200. Moreover, the arrangements of engagement portions 2235 and 2237 are identical. Therefore, the aforementioned arrangements are only described with respect to the arrangements of and between lifting mechanism 2225, drawing mechanism 2229, and engagement portion 2237.

As seen in FIGS. 24-26, lifting mechanism 2225 includes upper portion 2239 and lower portion 2241. Upper portion 2239 has bore portion 2243 of diameter D12 and extending from upper surface 2225*a* to intermediate surface 2225*b* and, thereby, extending towards lower surface 2225*c*. Lower portion 2241 has bore portion 2245 of diameter D13 and extending from lower surface 2225*c* to intermediate surface 2225*b* and, thereby, extending towards upper surface 2225*a*. It is noted that the conjunction of bore portions 2243 and 2245 constitute a stepped through bore of diameters D12 and D13, with D13 being dimensionally greater than D12. In exemplary embodiments, bore portions 2243 and 2245 may be configured to enable lifting mechanism 2225 to be concentrically disposed about drive screw 2217. According to exemplary embodiments, drive screw 2217 may include threaded portion 2217*a* of diameter D14 and is unthreaded portion 2217*b* of diameter D15, with D15 being dimensionally smaller than D14 and D14 being dimensionally smaller than D12. In this manner, bore portions 2243 and 2245 may be concentrically aligned with respect to imaginary axis of rotation A6.

Similarly, drawing mechanism 2229 includes upper portion 2247 and lower portion 2249. Upper portion 2247 has bore portion 2251 of, for example, diameter D12 and extending from upper surface 2229*a* to intermediate surface 2229*b* and, thereby, extending towards lower surface 2229*c*. Lower portion 2247 has bore portion 2253 of, for instance, diameter D13 and extending from lower surface 2229*c* to intermediate surface 2229*b* and, thereby, extending towards upper surface 2229*a*. Accordingly, the conjunction of bore portions 2251 and 2253 constitute a stepped through bore of diameters D12 and D13. Bore portions 2251 and 2253 may be configured, in exemplary embodiments, to enable drawing mechanism 2229 to be concentrically disposed about drive screw 2217. As such, bore portions 2251 and 2253 may be concentrically aligned with respect to imaginary axis of rotation A6.

According to various exemplary embodiments, bore portions 2245 and 2253 may be configured to receive corresponding members 2255 and 2257, which may be any suitable carrier nut. Carrier nuts 2255 and 2257 may include outer diameter D16, with D16 being dimensionally less than D13, but dimensionally greater than D12. Further, carrier nuts 2255 and 2257 may include respective internally threaded bores (not shown) configured to threadedly engage drive screw 2217. While not illustrated, an inner most diameter of each of the internally threaded bores may be dimensionally larger than diameter D15 of unthreaded portion 2217*b* of drive screw 2217. In this manner, rotation of drive screw 2217 about imaginary axis of rotation A6 in a first direction (e.g., a counterclockwise rotational direction) may be configured to cause carrier nuts 2255 and 2257 to be displaced along imaginary axis of rotation A6 in an upwards direction, such as towards, for example, upper frame member 2207. Rotation of drive screw 217 about imaginary axis of rotation A6 in a second direction (e.g., a clockwise rotational direction) may be configured to cause carrier nuts 2255 and 2257 to be displaced along imaginary axis of rotation A6 in a downwards direction, such as towards, for instance, lower frame member 2209.

Referring momentarily to FIG. 22 and with continued reference to FIG. 24, displacement of carrier nut 2255 along imaginary axis of rotation A6 is configured to cause, at least in part, displacement of lifting mechanism 2225 along imaginary axis of rotation A6. For instance, displacement of carrier nut 2255 may cause, at least in part, lifting mechanism 2225 to be displaced along imaginary axis of rotation A6 between position 2259, such as a lowered position, and position 2261, such as a raised position. Similarly, displacement of carrier nut 2257 along imaginary axis of rotation A6 is configured to cause, at least in part, displacement of drawing mechanism 2229 along imaginary axis of rotation A6. For example, displacement of carrier nut 2257 may cause, at least in part, drawing mechanism 2229 to be displaced along imaginary axis of rotation A6 between position 2263, such as lowered position, and position 2265, such as an intermediate position. It is noted that when carrier nut 2257 is displaced in the upwards direction towards upper frame member 2207 and reaches unthreaded portion 2217*b* of drive screw 2217, carrier nut 2257 will be disengaged from threaded portion 2217*a*. As such, carrier nut 2257 will cease causing, at least in part, drawing mechanism 2229 from being displaced in the upwards direction; however, drawing mechanism 2229 will remain at position 2265. Meanwhile, carrier nut 2255 will continue to cause, at least in part, lifting mechanism 2225 to be displaced in the upwards direction towards upper frame member 2207. As carrier nut 2255 causes, at least in part, lifting mechanism 2225 to be displaced along imaginary axis of rotation A6 towards position 2261, upper surface 2225*a* of lifting mechanism 2225 will is eventually abut lower surface 2229*c* of drawing mechanism 2229. At this point, carrier nut 2255 will cause, at least in part, lifting mechanism 2225, drawing mechanism 2229, and carrier nut 2257 to be displaced in the upwards direction along imaginary axis of rotation A6. Accordingly, lifting mechanism 2225 will be caused, at least in part, to be raised to position 2261 and drawing mechanism 2229 will be caused, at least in part, to be raised from intermediate position 2265 to position 2267, such as a raised position.

When drive screw 2217 is caused, at least in part, to be rotated about imaginary axis of rotation A6 in the second direction, carrier nut 2255 will be caused, at least in part, to be displaced in the downwards direction towards lower frame member 2209 and, thereby, enable lifting mechanism to be displaced in the downwards direction from position 2261 towards position 2259. As lifting mechanism 2225 displaces in the downwards direction, drawing mechanism 2229 will be enabled to displace from position 2267 to position 2265. Carrier nut 2257 will also be permitted to displace along unthreaded portion 2217*b* of drive screw 2217 and eventually reengage (e.g., threadedly reengage) threaded portion 2217*a*. Continued rotation of drive screw 2217 in the second direction will accordingly cause, at least in part, carrier nuts 2255 and 2257 to be displaced in the downwards direction and, thereby, enable lifting mechanism 2225 and drawing mechanism 2229 to be correspondingly lowered to respective positions 2259 and 2263. It is noted that when lifting mechanism 2225 is lowered to position 2259, lower surface 2225*c* of lifting mechanism 2225 will abut upper surface 2211*a* of bearing 2211, as will lower surface 2255*a* of carrier nut 2255. Further, when drawing mechanism 2229 is lowered to position 2263, lower surface 2229*c* of drawing mechanism 2229 will abut upper surface 2225*a* of lifting mechanism 2225, as will lower surface 2257*a* of carrier nut 2257.

It is further noted that when drawing mechanism 2229 is caused, at least in part, is to be displaced along imaginary axis of rotation A6 from position 2263 towards position 2265, displacement of lifting mechanism 2225 may be delayed or otherwise retarded. Namely, when lifting mechanism 2225 and drawing mechanism 2229 are in respective positions 2259 and 2263, lower surface 2255*a* of carrier nut 2255 abuts upper surface 2211*a* of bearing 2211 and lower surface 2257*a* of carrier nut 2257 abuts upper surface 2225*a* of lifting mechanism 2225. Thus, as carrier nuts 2255 and 2257 are caused, at least in part, to be displaced along axis of rotation A6 in the upwards direction, displacement of carrier nut 2257 will cause, at least in part, drawing mechanism 2229 to be displaced in the upwards direction. Displacement of carrier nut 2255 in the upwards direction, however, will not immediately cause, at least in part, lifting mechanism 2225 to be displaced in the upwards direction. This is because carrier nut 2255 must be caused, at least in part, to be displaced from a position where its lower surface 2255*a* abuts upper surface 2211*a* of bearing 2211 to another position where its upper surface 2255*b* abuts intermediate surface 2225*b* of lifting mechanism 2225 before carrier nut 2255 may cause, at least in part, lifting mechanism 2225 to be displaced in the upwards direction. Namely, carrier nut 2255 must at least travel a length of bore portion 2245 before lifting mechanism 2225 is caused, at least in part, to be displaced in the upwards direction. Accordingly, the distance carrier nut 2255 must travel before enabling lifting mechanism 2225 to be caused, at least in part, to be displaced in the upwards direction (and, thereby, the time it takes carrier nut 2255 to travel that distance) will correspondingly relate to an amount of time by which the displacement of lifting mechanism 2225 will be delayed or retarded. It is noted that this amount of time will also be proportional to an amount of spacing between carrier nuts 2255 and 2257 along imaginary axis of rotation A6, as well as be proportional to an amount of horizontal distance drawing mechanism 2229 via tethering line 2233 may draw, for example, vessel 200 towards mechanism 2200 and, thereby, is towards primary vessel 103. In this manner, the aforementioned spacing between carrier nuts 2255 and 2257, as well as the length of bore portion 2245 will also be proportional to the substantially horizontal distance drawing mechanism 2229 via tethering line 2233 may draw vessel 200 towards mechanism 2200 and, thereby, towards primary vessel 103.

With continued reference to FIGS. 24 and 25, lifting mechanism 2225 and drawing mechanism 2229 may, in exemplary embodiments, respectively include protrusion portions 2269 and 2271. Protrusion portion 2269 has coupling member 2273 mounted thereto, whereas protrusion portion 2271 has guide member 2275 rotationally mounted thereto. In this manner, tethering line 2233 may include a first distal end 2233*a* coupled to coupling member 2273, an intermediary portion guided about at least a portion of guide member 2275, and a second distal end 2233*b* configured to be detachably coupled to at least a portion of a load, such as auxiliary vessel 200. According to one embodiment, distal end 2233*b* may have a fitting, such as a snap fitting, or any other suitable connector configured to enable distal end 2233*b* to be detachably coupled to engagement portion 1521 of bracket 1500 and, thereby, detachably coupled to vessel 200. When, for instance, drawing mechanism 2229 is caused, at least in part, to be displaced along imaginary axis of rotation A6 in the upwards direction from position 2263 towards position 2265, but displacement of lifting mechanism 2225 is delayed, tethering line 2233 will be caused, at least in part, to draw a detachably coupled load, e.g., vessel 200, a horizontal (or substantially horizontal) distance. During this period of time, coupling member 2273 and, thereby, distal end 2233*a* will be caused, at least in part, to be displaced in the upwards direction; however, guide member 2275 will not be displaced in the upwards direction. Accordingly, the intermediate portion of tethering line 2233 will be guided about at least a portion of guide member 2273 and distal end 2233*b* and, thereby, the detachably coupled load will be caused, at least in part, to be drawn towards mechanism 2200. In this manner, the distance carrier nut 2255 must travel before enabling lifting mechanism 2225 to be caused, at least in part, to be displaced in the upwards direction will correspondingly relate to an amount of horizontal (or substantially horizontal) distance drawing mechanism 2229 via tethering line 2233 may be enabled to draw, for example, vessel 200 towards mechanism 2200 and, thereby, towards primary vessel 103. It is noted that this distance that carrier nut 2255 must travel (which may correspond to the length of bore portion 2245) will also be proportional to the amount of distance drawing mechanism 2229 via tethering line 2233 may draw the detachably coupled load.

According to exemplary embodiments, lifting mechanism 2225 may further include protrusion portions 2277 and 2279. Protrusion portion 2277 may be, for example, configured as a triangular prism extending from surface 2225*d* of lifting mechanism 2225. In this manner, protrusion portion 2277 may have one or more mounting bores, such as mounting bores 2277*a*-2277*d*, that enable protrusion portion 2277 to be, for instance, fastened (e.g., screwed, bolted, pinned, etc.) to lifting mechanism 2225. While not illustrated, mounting bores 2277*a*-2277*d* may have tapered (or otherwise countersunk) openings extending from respective surfaces 2277*e* and 2277*f* of protrusion portion 2277 to enable corresponding fasteners (not shown) to have surfaces that are flush or countersunk from surfaces 2277*e* and 2277*f*. Protrusions portion 2277 may further include chamfered surfaces 2277*g* and 2277*h*. It is noted that at least a portion of protrusion portion 2277 may be configured to slideably engage recessed channel 1523 of brackets 1500 and, thereby, the conjunction of recessed channel 1523 and protrusion portion 2277 may serve one or more alignment functions as vessel 200 is drawn towards mechanism 2200. Namely, when at least a portion of protrusion portion 2277 is slideably engaged within recessed channel 1523, vessel 200 will be aligned, e.g., centered, with is mechanism 2200. Further, when at least a portion of protrusion portion 2277 is fully engaged within recessed channel 1523, engagement pin 2237*a* of engagement portion 2237 will be concentrically aligned with blind bore 1515 of bracket 1500. At this point, engagement pin 2279*a* of protrusion portion 2279 will be concentrically aligned with blind bore 1513 of bracket 1500.

It is noted that when (or substantially when) at least a portion of protrusion portion 2277 is fully engaged within recessed channel 1523, upper surface 2255*a* of carrier nut 2255 will abut intermediate surface 2225*b* of lifting mechanism 2225. Continued displacement of carrier nut 2255 in the upwards direction will cause, at least in part, lifting mechanism 2225 to be displaced in the upwards direction and, thereby, enable engagement pin 2279*a* to be caused, at least in part, to be displaced in the upwards direction and, thereby, become slideably engaged within at least a portion of blind bore 1513 of bracket 1500. In this manner, bracket 1500 and, thereby, vessel 200 will become cantilevered from lifting mechanism 2225. Still further displacement of carrier nut 2255 in the upwards direction will cause, at least in part, lifting mechanism 2225 to reach position 2261. At this point, engagement pin 2237*a* of engagement portion 2237 will be slideably engaged within at least a portion of blind bore 1515 of bracket 1500. Thus, bracket 1500 will be secured by and between engagement pins 2237*a* and 2279*a*, such that vessel 200 will be secured to mechanism 2200 in a first state illustrated in FIG. 31.

Adverting back to FIGS. 22 and 23, additional structural support may be provided via ladder assembly 2281 including a pair of laterally spaced elongated vertical members 2283 and 2285 extending between upper frame member 2207 and lower frame member 2209. Ladder assembly 2281 has a plurality of steps (or rungs) 2287 including, in certain embodiments, corresponding upper surfaces affixed with one or more limited or nonslip materials, such as one is or more rubbers or other synthetic compounds. In one embodiment, ladder assembly 2281 may further include moveable portion 2289 having step (or rung) 2289*a* extending between a pair of laterally spaced elongated vertical members 2289*b* and 2289*c* that, according to exemplary embodiments, may telescope in relation to laterally spaced elongated vertical members 2283 and 2285. For instance, movable portion 2289 may telescope between a first (or fully extended) position 2291 and a second (or fully retracted) position 2293. In this manner, laterally spaced elongated vertical members 2289*b* and 2289*c* may telescope within laterally spaced elongated vertical members 2283 and 2285.

Since not all primary vessels are configured alike, mechanism 2200 may also include a configurable mounting mechanism 2295. In exemplary embodiments, mechanism 2295 is configured to enable mechanism 2200 to be coupled to at least one surface of a primary vessel, which may raked, as well as enable mechanism 2200 to be vertically (or substantially vertically) oriented. Accordingly, mechanism 2295 may include a plurality of upper and lower framing members configured to be securely engaged with one or more engagement flanges of columns 2203 and 2205, such as upper framing member 2295*a* and lower framing member 2295*b* securely engaged with corresponding portions of engagement flange 2205*a*. Mechanism 2295 may also include one or more framing members extending between and securely engaged with the one or more upper and lower framing members of mechanism 2295, such as framing members 2295*c* and 2295*d*. For instance, framing member 2295*d* may be securely engaged with upper framing member 2295*a* and lower framing member 2295*b*. In one embodiment, the upper and lower framing members of mechanism 2295 may be telescopic (or otherwise configurable) to enable the one or more framing members extending between the upper and lower framing members to be positioned in one or more configurations that correspond to the configuration of is the at least one surface of the primary vessel, such as configured in a raked manner.

While not illustrated, mechanism 2295 may also include one or more other framing members extending between and securely engaged with the one or more upper and lower framing members of mechanism 2295, such as one or more other framing members which may be parallel with upper and lower frame members 2207 and 2209 of structure 2201. In exemplary embodiments, framing member 2295*c* may include a plurality mounting bores, such as mounting bores 2297*a*-2297*e*, configured to enable mechanism 2295 and, thereby, mechanism 2200 to be, for instance, securely fastened (or otherwise coupled) to at least one surface of a primary vessel, such as transom 107 of primary vessel 103. Similarly, framing member 2295*d* may include a plurality of mounting bores, such as mounting bores 2299*a*-2299*e*, configured to enable mechanism 2295 and, thereby, mechanism 2200 to be securely fastened to the at least one surface.

Figure 27:
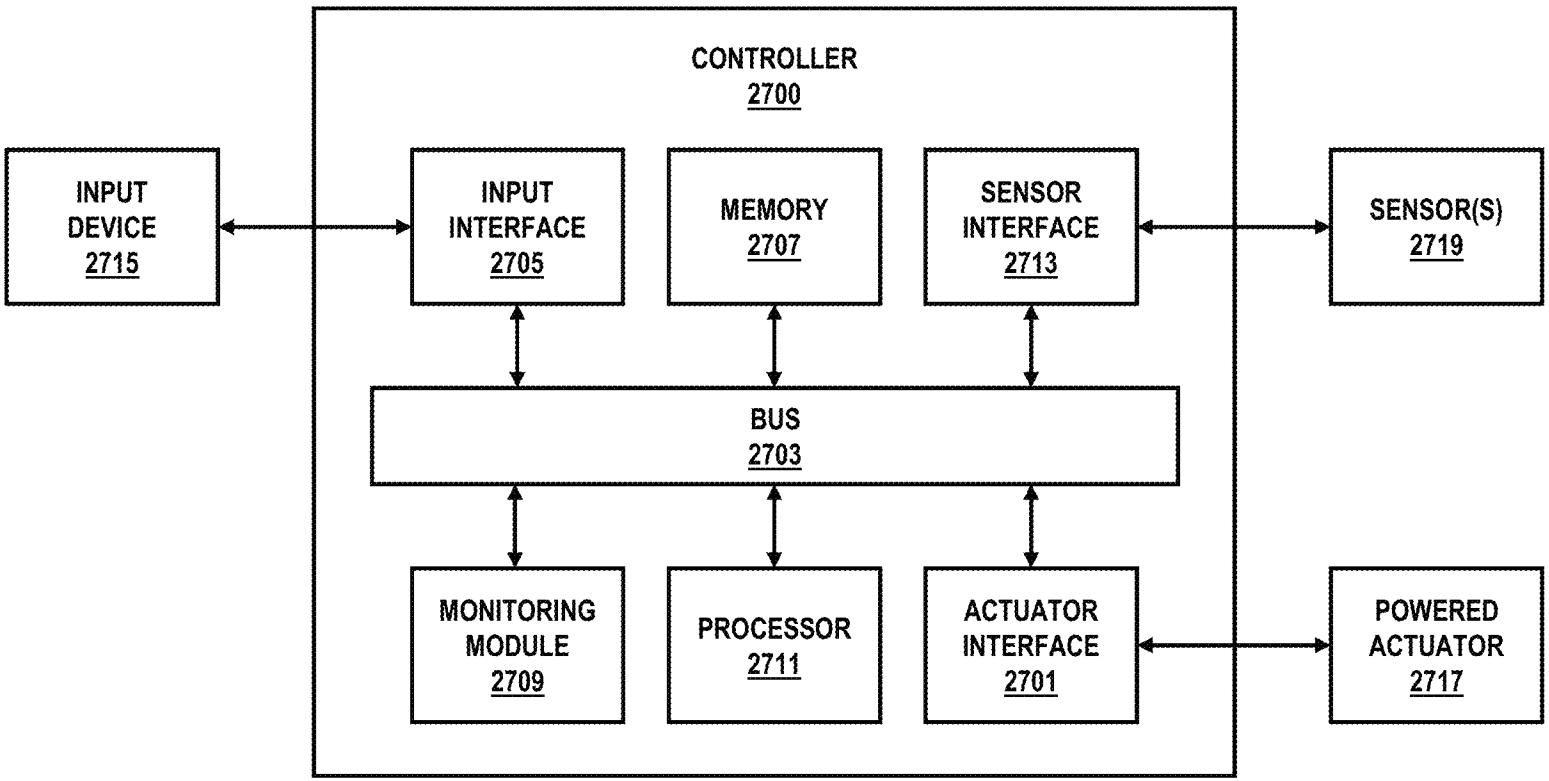
FIG. 27 is a block diagram of a controller of an auxiliary vessel storing and deploying mechanism, according to an exemplary embodiment.

FIG. 27 is a block diagram of a controller of an auxiliary vessel storing and deploying mechanism, according to an exemplary embodiment. Controller 2700 may comprise software, hardware, firmware, or a combination thereof, as well as include one or more other components configured to execute the processes described herein. In one implementation, controller 2700 may include one or more actuator interfaces 2701, buses 2703, input interfaces 2705, memories 2707, monitoring modules 2709, processors 2711, and/or sensor interfaces 2713. Users may access the features and functionality of controller 2700 via any suitable input device 2715, such one or more buttons. While specific reference will be made to this particular implementation, it is also contemplated that controller 2700 may embody many forms and include multiple and/or alternative components. For example, it is contemplated that the components of controller 2700 may be combined, located in separate structures, or even separate is locations.

According to exemplary embodiments, actuator interface 2701 is configured to exchange control and/or feedback information (e.g., instructions, parameters, signals, etc.) with one or more powered actuators 2717, such as powered actuator 2219. Likewise, sensor interface 2713 is configured to exchange control and/or feedback information with one or more sensors (or feedback mechanisms) 2719, such as one or more upper limit and lower limit sensors. In this manner, feedback information may be provided to monitoring module 2709 for monitoring the arrangement (e.g., spatial positioning) of one or more components of storing and deploying mechanism 2200 and, thereby, the arrangement of an auxiliary vessel (e.g., vessel 200) being stored or deployed via mechanism 2200. Accordingly, processor 2711 may dynamically manage the spatial configuration of the various components of mechanism 2200 based on one or more programs, signals, instructions, and/or data stored to or provided by, for example, actuator interface 2701, input interface 2705, memory 2707, monitoring module 2709, and/or sensor interface 2719. In exemplary embodiments, the physical configuration of the various components of mechanism 2200 and/or a load (e.g., vessel 200) being stored to or deployed from mechanism 2200 are referred to as states or positions; accordingly, a change in the physical configuration with respect to one or more of the various components and/or the load are considered changes in states. In this manner, monitoring module 2709 may be configured to monitor these states and may record corresponding information to memory 2707 for tracking, optimizing, or otherwise controlling the various components of mechanism 2200.

It is noted that control and feedback information (e.g., data, instructions, parameters, signals, etc.) for controlling powered actuator 2717 and, thereby, the spatial configuration of mechanism 2200 may be stored to memory 2707, e.g., any non-volatile memory, such as erasable programmable read-only memory (EPROM), electrically erasable programmable read-only memory (EEPROM). Memory 2707 may be implemented as one or more discrete devices, stacked devices, or integrated with processor 2711. Memory 2707 may represent a hierarchy or memory, which may include both random access memory (RAM) and read-only memory (ROM). Further, control functions may be implemented via processor 2711, which may be a single processor or multiple processors. Suitable processors 2711 may include, for example, both general purpose and special purpose processors, such as one or more digital signal processors. Thus, the various processes described herein may be caused, at least in part, by controller 2700, in response to processor(s) 2711 executing one or more arrangements of instructions contained in memory 2707. Execution of instructions contained in memory 2707 may cause processor(s) 2711 to cause, at least in part, or otherwise perform various actions described herein. It is noted that controller 2700 includes bus 2703 or any other suitable communication mechanism for communicating various information (e.g., data, instructions, parameters, signals, etc.) among and between components 2701-2713. It is also noted that hard-wired circuitry may be used in place of or in combination with software instructions to implement exemplary embodiments. Thus, various exemplary embodiments are not limited to any specific combination of hardware circuitry and software.

While not illustrated, controller 2700 may include and/or be further configured to toggle one or more status-indicators (not shown), such as one or more lamps, light emitting diodes, and/or the like. These status-indicators may be provided to convey one or more of the aforementioned states and/or positions of one or more of the various components of storing and deploying mechanism 2200. In this manner, a first status-indicator may be utilized to convey that mechanism 2200 is available for use and, thereby, functioning properly. Another status-indicator (or one or more toggled states of the first status-indicator) may be used to convey that mechanism 2200 and/or controller 2700 requires maintenance or repair. Another status indicator (or one or more other toggled states of the first status-indicator) may be utilized to convey faults of mechanism 2200 and/or controller 2700. For instance, controller 2700 may signal users of mechanism 2200 via one or more certain status-indicators and/or one or more signaling methods, a situation wherein controller 2700 detects (or otherwise determines) that an increased current (or voltage) is being drawn above one or more predetermined thresholds by one or more of the various components of mechanism 2200 and/or controller 2700 when, for instance, mechanism 2200 is being actuated. In this example, such an indication may be utilized to convey situations when maintenance is required in the form of, for instance, lubrication or cleaning of one or more of the various components of mechanism 2200 and/or controller 2700.

Figure 28:
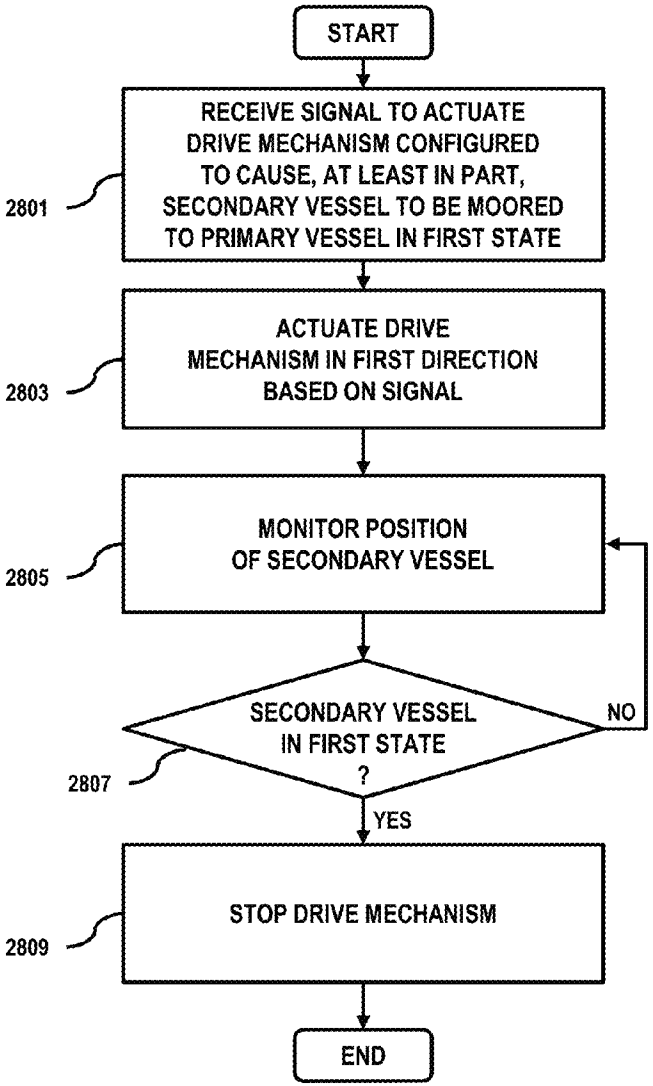
FIG. 28 is a flowchart of a process for capturing an auxiliary vessel, according to an exemplary embodiment.
Figure 29:
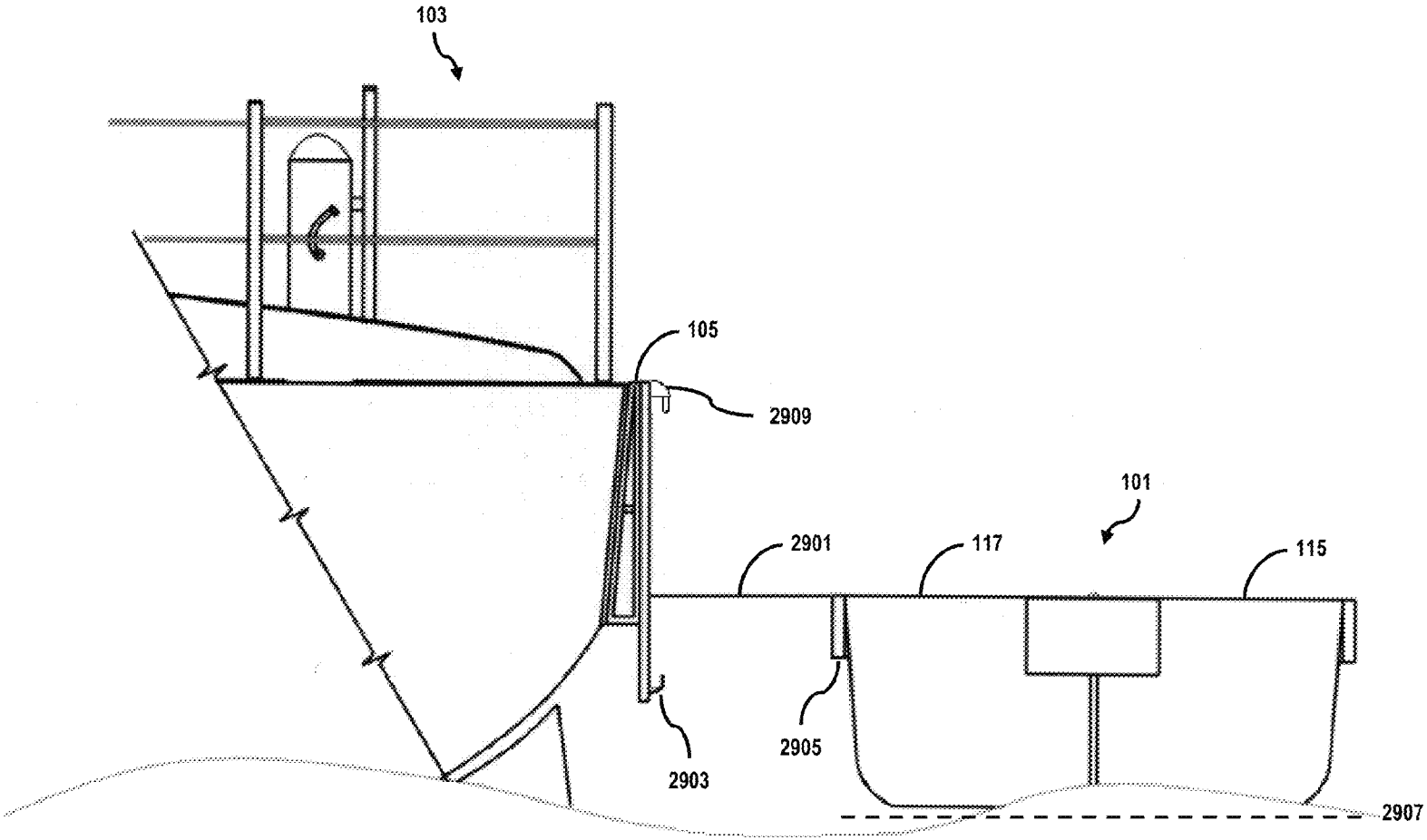
FIG. 29 is a side elevation view of an auxiliary vessel in a first state, according to an exemplary embodiment.
Figure 30:
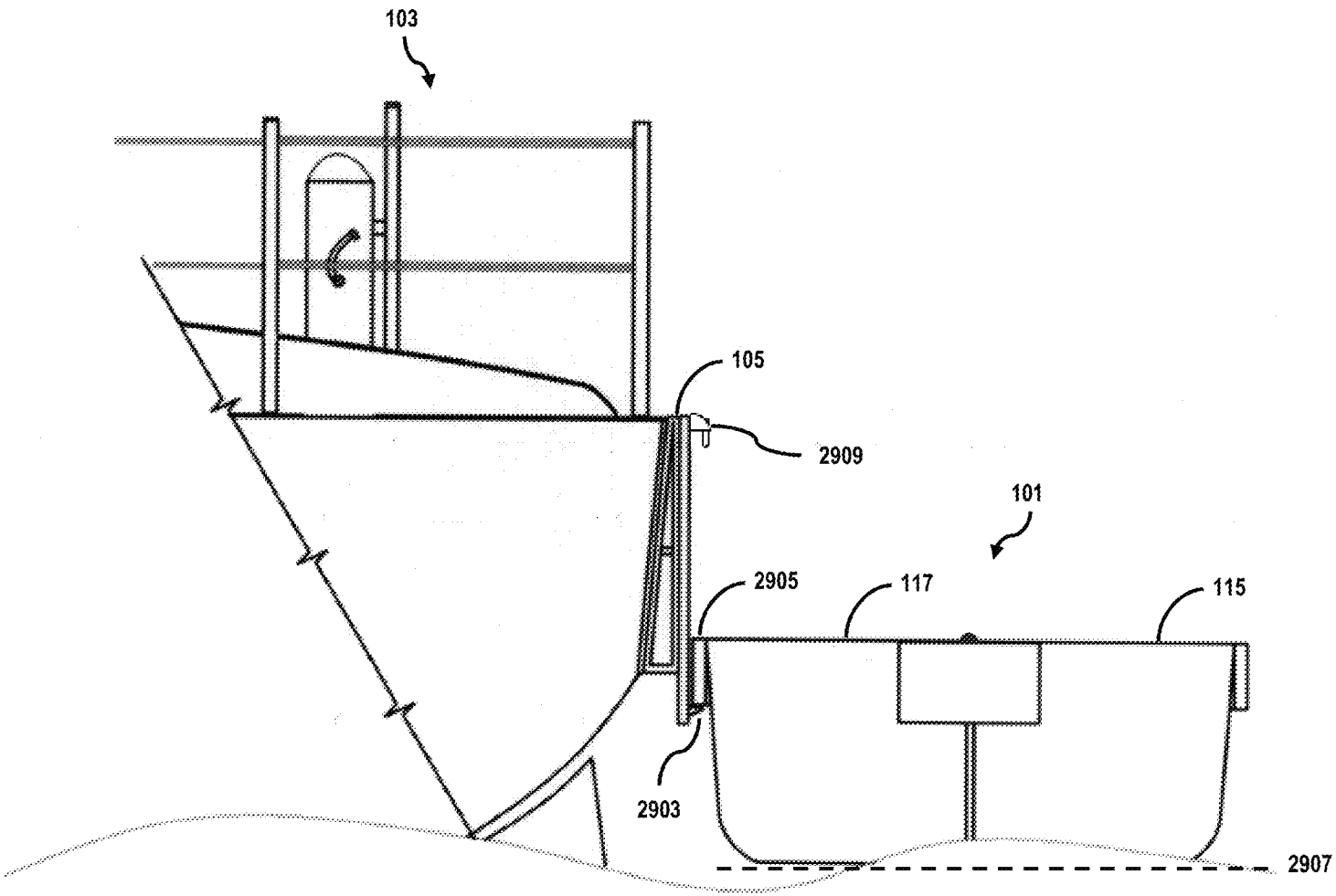
FIG. 30 is a side elevation view of an auxiliary vessel in a second state, according to an exemplary embodiment.
Figure 31:
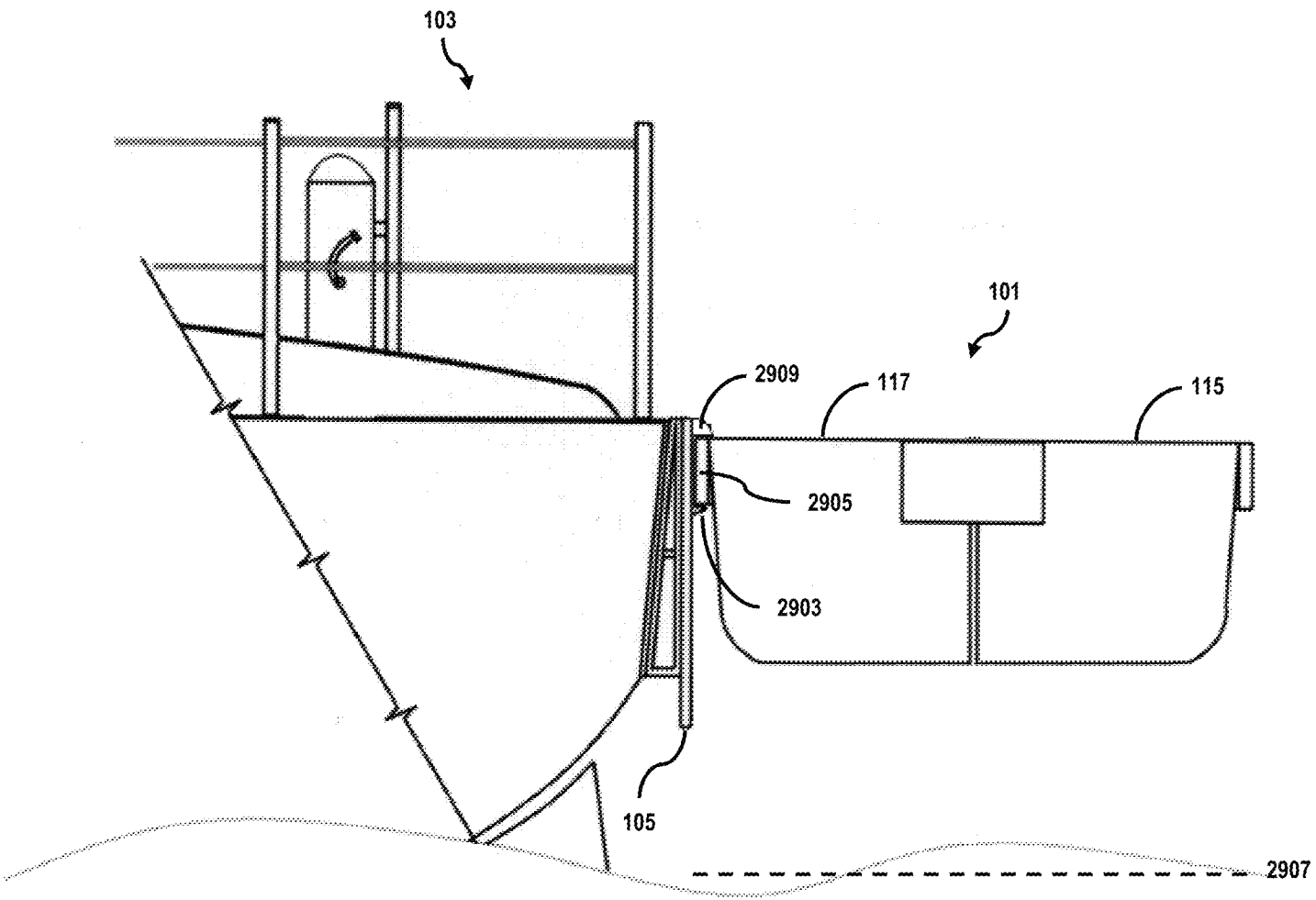
FIG. 31 is a side elevation view of an auxiliary vessel in a third state, according to an exemplary embodiment.
Figure 32:
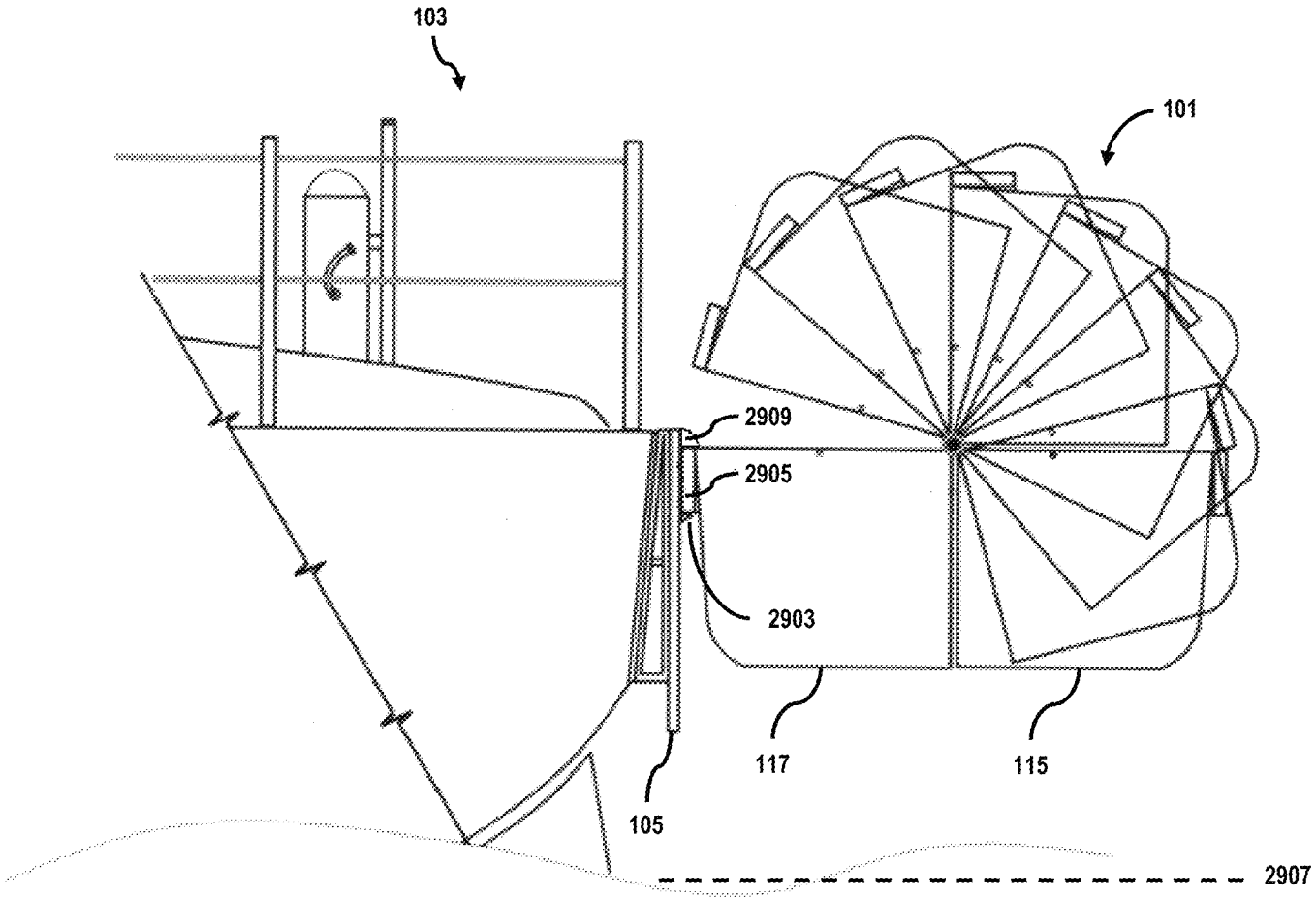
FIG. 32 is a side elevation view of an auxiliary vessel in a fourth state, according to an exemplary embodiment.

FIG. 28 is a flowchart of a process for storing an auxiliary vessel, according to an exemplary embodiment. For illustrative purposes, the process is described with reference to FIG. 27, as well as FIGS. 1 and 29-32 respectively depicting various side elevation views of auxiliary vessel 101 in various states. It is noted that the steps of the process may be combined or separated in any suitable manner. Further, it is noted that the process assumes that auxiliary vessel 101 has been tethered to storing and deploying mechanism 105 (as seen in FIG. 29) and, thereby, tethered to primary vessel 103 via one or more tethering lines, such as tethering line 2901. In this manner, controller 2700 may receive (at step 2801) at least one signal to actuate powered actuator 2717, which is configured to cause, at least in part, auxiliary vessel 101 to be moored to primary vessel 103 in a first state, such as illustrated in FIG. 31.

As described in association with FIGS. 22-26, powered actuator 2717 is configured to cause, at least in part, drive mechanisms 2215 and 2217 to be actuated in one or is more directions, e.g., a first direction and a second direction. In this manner, controller 2700 actuates powered actuator 2717 in a first direction based on the received signal, per step 2803. Once actuated, powered actuator 2717 is configured to cause, at least in part, auxiliary vessel 101 to be drawn towards storing and deploying mechanism 105 and, thereby, towards primary vessel 103, as illustrated in FIG. 30 and described in association with FIGS. 22-26. In one embodiment, auxiliary vessel 101 is drawn towards primary vessel 103 in a substantially horizontal direction. Continued actuation of powered actuator 2717 is configured to cause, at least in part, at least one first engagement portion, such as engagement portion 2903, to detachably engage auxiliary vessel 101 via, for instance, corresponding brackets 2905 of auxiliary vessel 101, as described in association with FIGS. 15-17 and 22-26. Further actuation of powered actuator 2717 is configured to cause, at least in part, storing and deploying mechanism 105 to raise auxiliary vessel 101 from horizontal (or substantially horizontal) plane 2907 to the first state illustrated in FIG. 31. When auxiliary vessel 101 is in the first state, at least one second engagement portion, such as engagement portion 2909, will slideably engage auxiliary vessel 101 via, for instance, corresponding brackets 2905, such as described in association with FIGS. 15-17 and 22-26.

In this manner, controller 2700 (via, for example, monitoring module 2709) may be configured to monitor a position of auxiliary vessel 101, per step 2805. That is, monitoring module 2709 may monitor feedback from, for instance, one or more sensors 2719 configured to provide monitoring module 2709 with feedback information corresponding to spatial positioning of at least one lifting mechanism of storing and deploying mechanism 105 and, thereby, the spatial positioning of auxiliary vessel 101. At step 2807, controller 2700 determines whether auxiliary vessel 101 has been caused, at least in part, to be raised to the first state. If auxiliary is vessel 101 is not in the first state, controller 2700 will continue to monitor the position of auxiliary vessel 101 and, thereby, continue to actuate powered actuator 2717. However, if auxiliary vessel 101 is in the first state, controller 2700 may stop actuating powered actuator 2717, per step 2809. It is noted that, in certainly exemplary embodiments, mechanism 2200 may be manually actuated via, for instance, wench 2221 and/or any other suitable, manually operated crank mechanism, which may be integrated (or otherwise incorporated) with one or more of drive mechanisms 2215 and 2217. This may be useful in situations when an insufficient amount of power exists to actuate mechanism 2200 and/or controller 2700. It is also noted that during manual operation of mechanism 2200, controller 2700 may still be utilized to monitor one or more states and/or conditions of mechanism 2200. At this point, hull portion 115 may be rotated (or otherwise folded) atop hull portion 117 and, thereby, moved from an open configuration to a closed configuration, as illustrated via FIGS. 1, 31, and 32. Thus, hull portions 115 and 117 may create enclosed interior cavity region 113, as seen in FIG. 1.

Figure 33:
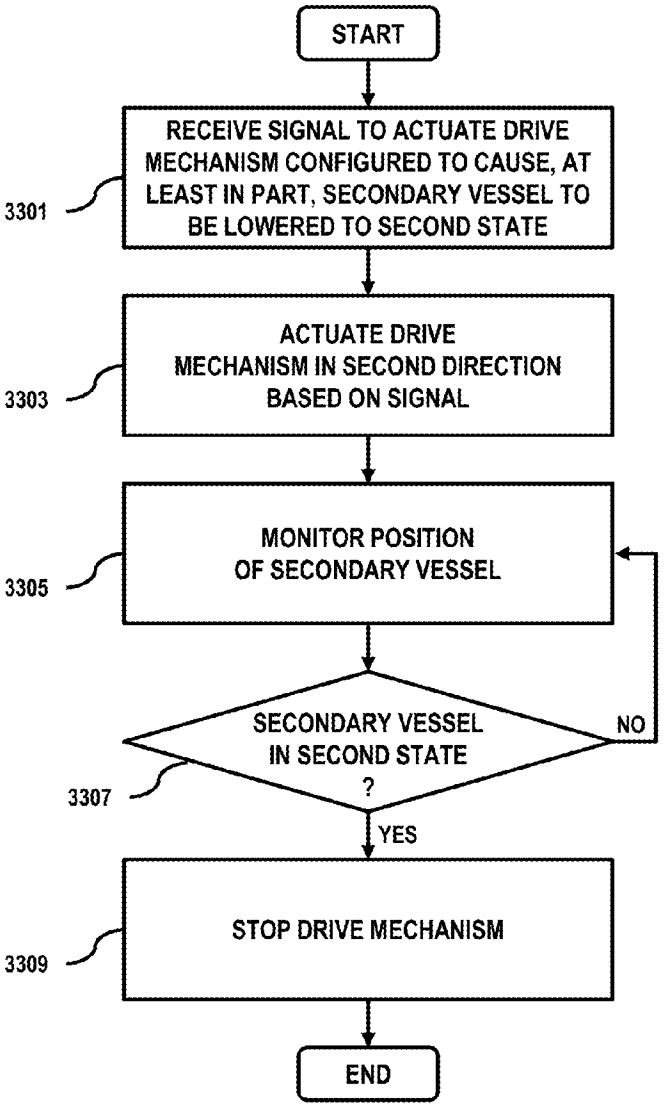
FIG. 33 is a flowchart of a process for deploying an auxiliary vessel, according to an exemplary embodiment.
Figure 34:
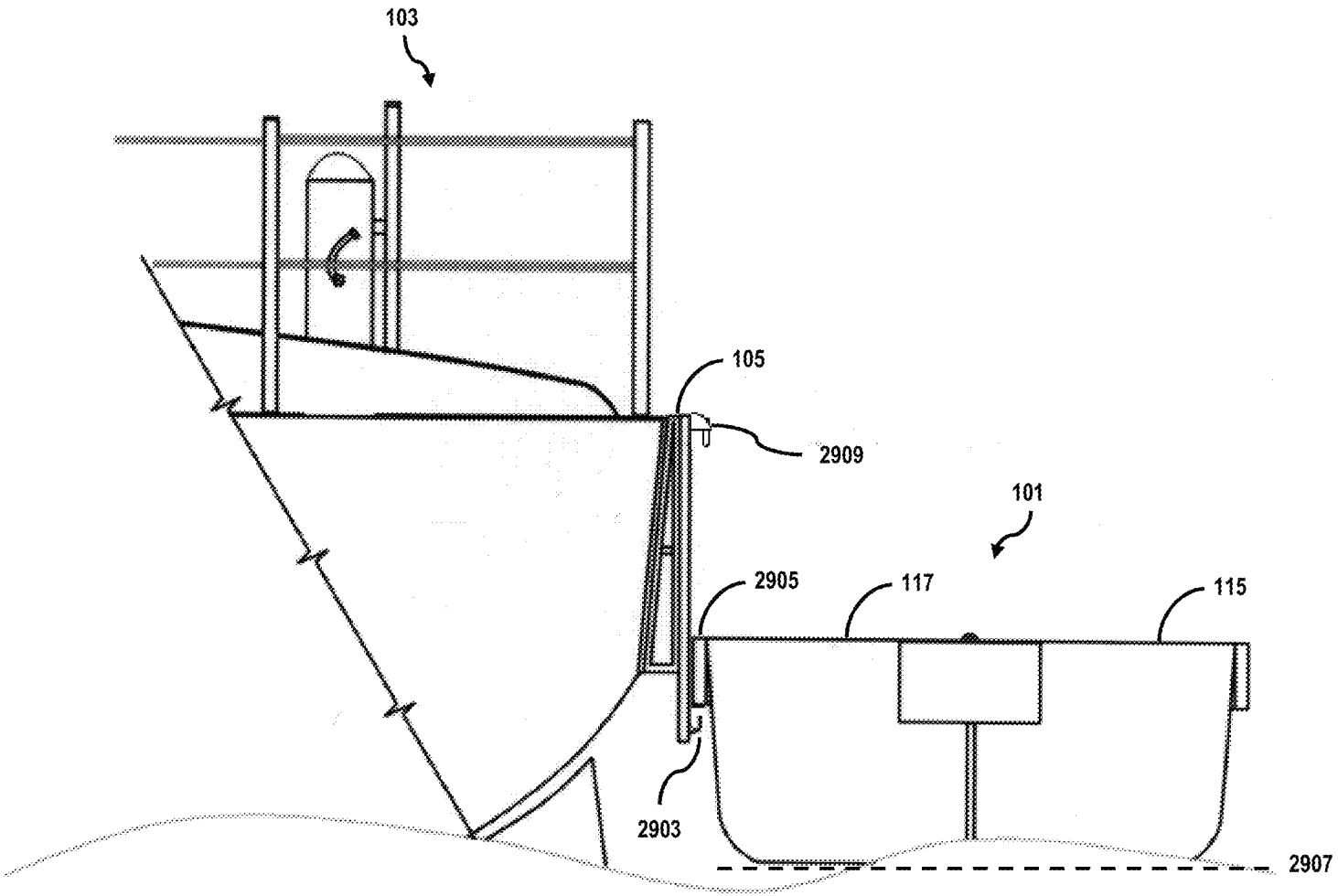
FIG. 34 is a side elevation view of an auxiliary vessel in a fifth state, according to an exemplary embodiment.

FIG. 33 is a flowchart of a process for deploying an auxiliary vessel, according to an exemplary embodiment. For illustrative purposes, the process is described with reference to FIG. 27, as well as FIGS. 31 and 34 respectively depicting various side elevation views of auxiliary vessel 101 in various states. It is noted that the steps of the process may be combined or separated in any suitable manner. Further, it is noted that the process assumes that auxiliary vessel 101 is in a raised, opened configuration, as seen in FIG. 31. In this manner, controller 2700 may receive (at step 3301) at least one signal to actuate powered actuator 2717, which is configured to cause, at least in part, auxiliary vessel 101 to be lowered from a first state (seen in FIG. 31) to a second state (seen in FIG. 34).

As previously described, powered actuator 2717 is configured to cause, at least in part, drive mechanisms 2215 and 2217 to be actuated in one or more directions, e.g., a first direction and a second direction. In this manner, controller 2700 actuates powered actuator 2717 in a second direction based on the received signal, per step 3303. Once actuated, powered actuator 2717 is configured to cause, at least in part, auxiliary vessel 101 to be lowered from the first state towards the second state. As previously described, actuation of mechanism 2200 may be additionally or alternatively accomplished via one or more manually operated components, such as wench 2221. Thus, controller 2700 (via, for example, monitoring module 2709) may be configured to monitor a position of auxiliary vessel 101, per step 3305. Namely, monitoring module 2709 may monitor feedback from, for instance, one or more sensors 2719 configured to provide monitoring module 2709 with feedback information corresponding to spatial positioning of at least one lifting mechanism of storing and deploying mechanism 105 and, thereby, the spatial positioning of auxiliary vessel 101. At step 3307, controller 2700 determines whether auxiliary vessel 101 has been caused, at least in part, to be lowered to the second state. If auxiliary vessel 101 is not in the second state, controller 2700 will continue to monitor the position of auxiliary vessel 101 and, thereby, continue to actuate powered actuator 2717. However, if auxiliary vessel 101 is in the second state, controller 2700 may stop actuating powered actuator 2717, per step 3309. At this point, auxiliary vessel 101 may be untethered from storing and deploying mechanism 105 and, thereby, unmoored from primary vessel 103.

While certain exemplary embodiments and implementations have been described, other embodiments and modifications will be apparent from this description. Accordingly, the invention is not limited to such embodiments, but rather to the broader scope of the presented claims and various obvious modifications and equivalent arrangements.

What is claimed is:

1. An apparatus comprising:

a support structure configured to engage at least one surface of a primary vessel;

a drive mechanism supported by the support structure;

a drawing mechanism configured to be actuated, at least in part, by the drive mechanism and, when actuated to cause, at least in part, a secondary vessel to be moored in a first state to the primary vessel, configured to cause, at least in part, the secondary vessel to be drawn towards the primary vessel in a substantially horizontal direction; and a lifting mechanism configured to be actuated, at least in part, by the drive mechanism and, when actuated to cause the secondary vessel to be moored in the first state to the primary vessel, configured to cause, at least in part, the secondary vessel to be raised from a substantially horizontal plane to the first state, wherein the lifting mechanism comprises an engagement portion configured to detachably engage the secondary vessel after the secondary vessel is drawn the substantially horizontal distance.

2. The apparatus of claim 1, wherein the drive mechanism comprises a drive screw, the drive screw being substantially vertically oriented.

3. The apparatus of claim 2, wherein displacement of a first member along an axis of rotation of the drive screw is configured to displace the drawing mechanism along the axis of rotation, and displacement of a second member along the axis of rotation of the drive screw is configured to displace the lifting mechanism along the axis of rotation.

4. The apparatus of claim 3, wherein spacing between the first member and the second member along the axis of rotation is configured, at least in part, to delay displacement of the lifting mechanism when the secondary vessel is being drawn towards the primary vessel.

5. The apparatus of claim 3, further comprising:

a guide member coupled to the lifting mechanism; and a tethering line coupled to the drawing mechanism at a first end and detachably coupled to the secondary vessel at a second end, wherein, when the secondary vessel is being drawn towards the primary vessel, displacement of the first member along the axis of rotation is configured to cause, at least in part, a portion of the tethering line to be guided about a portion of the guide member and configured to cause, at least in part, the tethering line to draw the secondary vessel towards the primary vessel in the substantially horizontal direction.

6. The apparatus of claim 1, wherein the secondary vessel comprises an outboard propulsion device.

7. A method comprising:

causing, at least in part, a first signal to be received to actuate a drive mechanism configured to cause, at least in part, a secondary vessel to be moored in a first state to a primary vessel; and causing, at least in part, the drive mechanism to be actuated in a first direction based on the first signal, wherein causing, at least in part, the drive mechanism to be actuated in the first direction is configured to cause, at least in part, a drawing mechanism to draw the secondary vessel towards the primary vessel and configured to cause, at least in part, a lifting mechanism to raise the secondary vessel from a substantially horizontal plane to the first state, and wherein the lifting mechanism comprises an engagement portion configured to detachably engage the secondary vessel after the secondary vessel is drawn towards the primary vessel via the drawing mechanism.

8. The method according to claim 7, wherein spacing between a first member and a second member along an axis of rotation of the drive mechanism is configured, at least in part, to delay displacement of the lifting mechanism when the drive mechanism is caused, at least in part, to be actuated in the first direction.

9. The method according to claim 8, wherein a guide member is mounted to the lifting mechanism and a tethering line is coupled to the drawing mechanism at a first end and detachably coupled to the secondary vessel at a second end, and wherein displacement of the first member along the axis of rotation when the drive mechanism is actuated in the first direction is configured to cause, at least in part, a portion of the tethering line to be guided about a portion of the guide member and configured to cause, at least in part, the tethering line to draw the secondary vessel towards the primary vessel in a substantially horizontal direction.

10. The method according to claim 7, further comprising:

causing, at least in part, a second signal to be received to actuate the drive mechanism, the drive mechanism being further configured to cause, at least in part, the secondary vessel to be lowered from the first state; and causing, at least in part, the drive mechanism to be actuated in a second direction based on the second signal, wherein causing, at least in part, the drive mechanism to be actuated in the second direction is configured to cause, at least in part, the lifting mechanism to lower the secondary vessel towards the substantially horizontal plane to a second state.

11. A maritime system comprising:

a primary vessel;

a mooring apparatus coupled to the primary vessel; and a secondary vessel configured to be moored to the primary vessel via the mooring apparatus, the secondary vessel comprising:

a first hull shell longitudinally extending from a first surface to a second surface and comprising a first opening to a first interior cavity region;

a second hull shell longitudinally extending from a third surface to a fourth surface and comprising a second opening to a second interior cavity region; and at least one hinge assembly connected between the first hull shell and the second hull shell, the at least one hinge assembly being configured to enable the first hull shell and the second hull shell to move between a closed configuration in which the first interior cavity region and the second interior cavity region confront one another to form an enclosed interior cavity region, and an opened configuration in which the first interior cavity region and the second interior cavity region are separated, wherein the first surface and the third surface define a bow of the secondary vessel and the second surface and the fourth surface define a stern of the secondary vessel.

12. The maritime system according to claim 11, wherein the first hull shell comprises a fifth surface longitudinally extending from the first surface to the second surface and defining, in the open configuration, a starboard surface of the secondary vessel, the secondary vessel further comprising:

a first bracket coupled to the fifth surface, the first bracket being configured to enable the secondary vessel to be, in a first moored state, detachably cantilevered from the primary vessel via the mooring apparatus.

13. The maritime system according to claim 12, wherein the first bracket comprises at least one recessed portion configured to dynamically align the secondary vessel with a lifting mechanism of the mooring apparatus.

14. The maritime system according to claim 12, wherein the second hull shell comprises a sixth surface longitudinally extending from the third surface to the fourth surface and defining, in the open configuration, a port surface of the secondary vessel, the secondary vessel further comprising:

a second bracket coupled to the sixth surface, the second bracket being configured to enable the secondary vessel to be, in a second moored state, detachably cantilevered from the primary vessel via the mooring apparatus.

15. The maritime system according to claim 11, wherein the first hull shell comprises at least one locking pin and the second hull shell comprises at least one bore that, in the opened configuration, is configured to align with and receive the at least one locking pin to secure the first hull shell and the second hull shell in the opened configuration.

16. The maritime system according to claim 15, wherein the secondary vessel further comprises:

a locking mechanism configured to slideably engage the at least one locking pin to secure the first hull shell and the second hull shell in the opened configuration.

17. The maritime system according to claim 16, wherein the locking mechanism is configured to be toggled between a locked state and an unlocked state, the locking mechanism further comprising:

an actuator comprising a first axis of rotation, wherein rotation of the actuator about the first axis of rotation is configured to enable the locking mechanism to toggle between the locked state and the unlocked state.

18. The maritime system according to claim 11, wherein the secondary vessel further comprises:

an outboard propulsion device bracket detachably coupled to either the second surface or the fourth surface, the outboard propulsion device bracket being configured to enable an outboard propulsion device to be detachably coupled to the secondary vessel with a centerline of the outboard propulsion device being substantially aligned with a centerline of the secondary vessel.

19. The maritime system according to claim 11, wherein the secondary vessel further comprises:

at least one thwart disposed within the first hull shell or the second hull shell, the at least one thwart comprising a lower portion comprising positive flotation material.

20. The method of claim 7, wherein the secondary vessel comprises an outboard propulsion device.

* * * * *